US011162465B2

(12) United States Patent
Saizen et al.

(10) Patent No.: US 11,162,465 B2
(45) Date of Patent: Nov. 2, 2021

(54) FUEL INJECTION VALVE

(71) Applicant: DENSO CORPORATION, Kariya (JP)

(72) Inventors: Makoto Saizen, Kariya (JP); Shuichi Matsumoto, Kariya (JP); Moriyasu Goto, Kariya (JP)

(73) Assignee: DENSO CORPORATION, Kariya (JP)

( * ) Notice: Subject to any disclaimer, the term of this patent is extended or adjusted under 35 U.S.C. 154(b) by 136 days.

(21) Appl. No.: 16/539,223

(22) Filed: Aug. 13, 2019

(65) Prior Publication Data

US 2019/0360442 A1 Nov. 28, 2019

Related U.S. Application Data

(63) Continuation of application No. PCT/JP2018/005447, filed on Feb. 16, 2018.

(30) Foreign Application Priority Data

Mar. 3, 2017 (JP) ..... JP2017-040729

(51) Int. Cl.
*F02M 51/00* (2006.01)
*B05B 1/30* (2006.01)
*F02M 51/06* (2006.01)

(52) U.S. Cl.
CPC ..... *F02M 51/00* (2013.01); *B05B 1/3053* (2013.01); *F02M 51/0628* (2013.01);
(Continued)

(58) Field of Classification Search
CPC ..... F02M 51/0628; F02M 51/0685; F02M 2200/8084; F02M 2200/8061; F02M 2200/08; F02M 51/06; B05B 1/3053
(Continued)

(56) References Cited

U.S. PATENT DOCUMENTS 6,510,841 B1 * 1/2003 Stier ..... F02M 51/0625 123/472
7,607,593 B2 * 10/2009 Akabane ..... F02M 51/0682 239/585.1

(Continued)

FOREIGN PATENT DOCUMENTS

JP 2006-348807 12/2006
JP 2013-104340 5/2013

(Continued)

OTHER PUBLICATIONS

U.S. Appl. No. 16/539,292 to Imai, filed Aug. 13, 2019 (68 pages).

(Continued)

*Primary Examiner* — Chee-Chong Lee
*Assistant Examiner* — Kevin Edward Schwartz
(74) *Attorney, Agent, or Firm* — Nixon & Vanderhye P.C.

(57) ABSTRACT

A fuel injection valve configured to inject fuel from an injection hole includes: a coil that is configured to generate a magnetic flux when the coil is energized; a stationary core that forms a portion of a flow passage, which is configured to conduct the fuel to the injection hole, wherein the stationary core is configured to become a passage of the magnetic flux; a movable core that is configured to be attracted toward the stationary core when the movable core becomes a passage of the magnetic flux; a passage forming portion that is placed on a downstream side of the stationary core and forms a portion of the flow passage; and a covering portion that covers a stationary boundary, which is a boundary between the passage forming portion and the stationary core, from a flow passage side of the stationary boundary where the flow passage is located.

8 Claims, 11 Drawing Sheets

(52) U.S. Cl.
CPC ..... *F02M 51/0685* (2013.01); *F02M 2200/08* (2013.01); *F02M 2200/8061* (2013.01); *F02M 2200/8084* (2013.01)

(58) Field of Classification Search
USPC ..... 239/585.5
See application file for complete search history.

(56) References Cited

U.S. PATENT DOCUMENTS

| | | | | |
|---|---|---|---|---|
| 2001/0019084 | A1* | 9/2001 | Cohen ..... | F02M 21/0254 239/585.1 |
| 2019/0331076 | A1 | 10/2019 | Saizen et al. | |

FOREIGN PATENT DOCUMENTS

| | | |
|---|---|---|
| JP | 2018-25184 | 2/2018 |
| WO | 2018-159326 | 9/2018 |
| WO | 2018-159327 | 9/2018 |

OTHER PUBLICATIONS

U.S. Appl. No. 16/539,321 to Saizen, et al., filed Aug. 13, 2019 (64 pages).

* cited by examiner

FUEL INJECTION VALVE

CROSS REFERENCE TO RELATED APPLICATIONS

This application is a continuation application of International Patent Application No. PCT/JP2018/005447 filed on Feb. 16, 2018, which designated the U.S. and claims the benefit of priority from Japanese Patent Application No. 2017-40729 filed on Mar. 3, 2017. The entire disclosures of all of the above applications are incorporated herein by reference.

TECHNICAL FIELD

The present disclosure relates to a fuel injection valve.

BACKGROUND

For example, a previously proposed fuel injection valve includes: a valve housing, which receives a valve element; a coil, which generates a magnetic flux when the coil is energized; and a stationary core and a movable core, which form a passage of the magnetic flux. The valve housing includes a valve seat member, at which an injection hole is formed, and a support tubular body, which supports the valve seat member. An opening end side of the valve seat member, which is opposite from the injection hole, is inserted into an inside of the support tubular body.

SUMMARY

According to the present disclosure, there is provided a fuel injection valve, in which a covering portion covers a stationary boundary, which is a boundary between a passage forming portion and a stationary core, from a flow passage side of the stationary boundary where the flow passage is located.

BRIEF DESCRIPTION OF DRAWINGS

The present disclosure, together with additional objectives, features and advantages thereof, will be best understood from the following description in view of the accompanying drawings.

DETAILED DESCRIPTION

Figure 1:
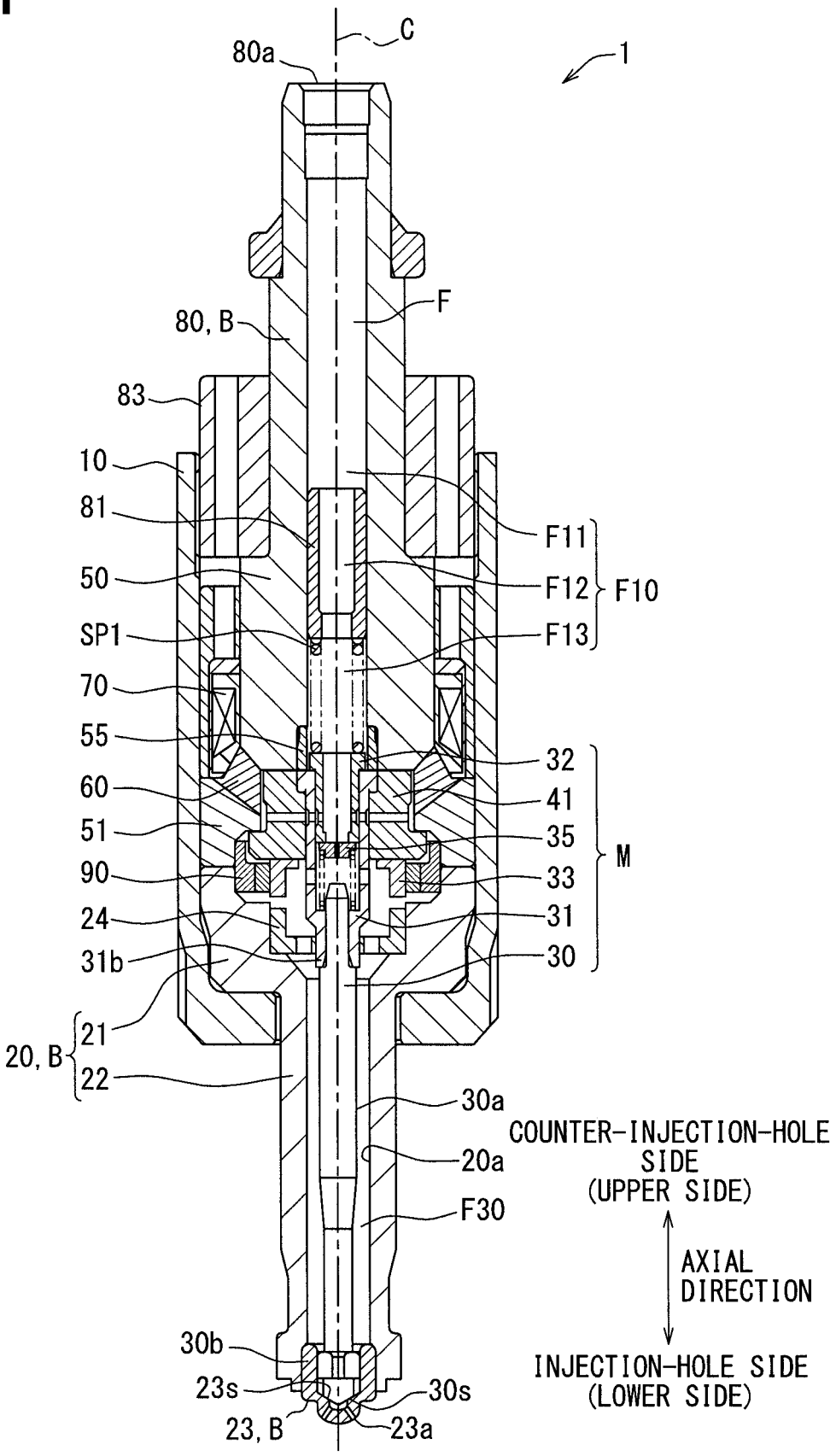
FIG. 1 is a cross-sectional view of a fuel injection valve according to a first embodiment.

As a fuel injection valve, which injects fuel from an injection hole, there has been proposed a fuel injection valve that includes: a valve housing, which receives a valve element; a coil, which generates a magnetic flux when the coil is energized; and a stationary core and a movable core, which form a passage of the magnetic flux. The valve housing includes a valve seat member, at which the injection hole is formed, and a support tubular body, which supports the valve seat member. An opening end side of the valve seat member, which is opposite from the injection hole, is inserted into an inside of the support tubular body. The support tubular body is made of a magnetic material. Furthermore, similar to the stationary core and the movable core, the support tubular body becomes a passage of the magnetic flux when the magnetic flux is generated in response to the energization of the coil.

The support tubular body has a projecting portion that radially inwardly projects. When the opening end of the valve seat member contacts the projecting portion of the support tubular body through a shim, excess insertion of the valve seat member into the inside of the support tubular body in the axial direction of the coil is limited at the time of, for example, assembling the valve seat member and the support tubular body together. The projecting portion of the support tubular body and the shim are arranged one after the other in the axial direction of the coil. An inside space of the valve housing has a flow passage, through which the fuel is conducted to the injection hole. The valve seat member, the shim and the support tubular body form this flow passage.

However, in the above described structure, when a fuel pressure in the flow passage becomes high, the fuel tends to intrude into a gap between the valve seat member and the shim, and/or the valve seat member and the support tubular body may be easily separated from each other in the axial direction of the coil. In any of these cases, when the fuel leaks from the flow passage, the injection of the fuel from the fuel injection valve cannot be appropriately executed.

According to one aspect of the present disclosure, there is provided a fuel injection valve configured to inject fuel from an injection hole. The fuel injection valve includes: a coil that is configured to generate a magnetic flux when the coil is energized; a stationary core that forms a portion of a flow passage, which is configured to conduct the fuel to the injection hole, wherein the stationary core is configured to become a passage of the magnetic flux; a movable core that is configured to be attracted toward the stationary core when the movable core becomes a passage of the magnetic flux; a passage forming portion that is placed on a downstream side of the stationary core in an axial direction of the coil and forms a portion of the flow passage; and a covering portion that covers a stationary boundary, which is a boundary between the passage forming portion and the stationary core, from a flow passage side of the stationary boundary where the flow passage is located.

According to the above aspect, since the passage forming portion and the stationary core are placed adjacent to each other, the passage forming portion and the stationary core can be joined together by welding. Therefore, leakage of the fuel to the outside through the gap between the passage forming portion and the stationary core and the separation between the passage forming portion and the stationary core in the axial direction of the coil by the fuel pressure in the flow passage can be limited.

Here, it is assumed that the flow passage is a narrow space in the fuel injection valve. Therefore, at the time of executing a welding operation for welding between the passage forming portion and the stationary core in the manufacturing of the fuel injection valve, heat is applied to the boundary between the passage forming portion and the stationary core from the outside of the fuel injection valve. In this case, spatter particles, such as slag, metal particles or the like, which are generated at the time of welding, may possibly be scattered from the boundary between the passage forming portion and the stationary core toward the flow passage. When the spatter particles are scattered in the flow passage, there is a possibility that the fuel is not appropriately injected from the injection hole due to the presence of the spatter particles after the completion of the manufacturing of the fuel injection valve.

In contrast, according to above-described aspect, the boundary between the passage forming portion and the stationary core is covered by the covering portion from the flow passage side. Therefore, at the time of manufacturing the fuel injection valve, the covering portion is installed relative to the boundary between the passage forming portion and the stationary core, and thereafter the passage forming portion and the stationary core are welded together. Thus, the scattering of the spatter particles into the flow passage can be limited.

In contrast, according to the above-described aspect, the boundary between the passage forming portion and the stationary core is covered by the covering portion from the flow passage side. Therefore, at the time of manufacturing the fuel injection valve, the covering portion is installed relative to the boundary between the passage forming portion and the stationary core, and thereafter the passage forming portion and the stationary core are welded together. Thus, the scattering of the spatter particles into the flow passage can be limited.

First Embodiment

A fuel injection valve 1 shown in FIG. 1 is installed to a gasoline engine (serving as an ignition internal combustion engine) and directly injects fuel into a corresponding combustion chamber of the engine that is a multicylinder type. The fuel to be supplied to the fuel injection valve 1 is pumped by a fuel pump (not shown) that is driven by a rotational drive force of the engine. The fuel injection valve 1 includes a case 10, a nozzle body 20, a valve element 30, a movable core 41, stationary cores 50, 51, a non-magnetic member 60, a coil 70 and a pipe connecting portion 80.

The case 10 is made of metal and is shaped into a cylindrical tubular form that extends in an axial direction of a center line C of the coil 70 that is shaped into a ring form. The center line C of the coil 70 coincides with a central axis of the case 10, the nozzle body 20, the valve element 30, the movable core 41, the stationary cores 50, 51 and the non-magnetic member 60.

The nozzle body 20 is made of metal and includes: a body main portion 21 that is inserted into and is engaged with the case 10; and a nozzle portion 22 that extends from the body main portion 21 to the outside of the case 10. The body main portion 21 and the nozzle portion 22 are respectively shaped into a cylindrical tubular form that extends in the axial direction. An injection hole member 23 is installed to a distal end of the nozzle portion 22.

The injection hole member 23 is made of metal and is securely welded to the nozzle portion 22. The injection hole member 23 is a bottomed cylindrical tubular form that extends in the axial direction. An injection hole 23*a*, which injects the fuel, is formed at a distal end of the injection hole member 23. A seatable surface 23*s* is formed at an inner peripheral surface of the injection hole member 23, and the valve element 30 can be lifted from and seated against the seatable surface 23*s*.

The valve element 30 is made of metal and is shaped into a cylindrical columnar form that extends in the axial direction. The valve element 30 is installed in an inside of the nozzle body 20 in a state where the valve element 30 is movable in the axial direction. A flow passage, which is in an annular form and extends in the axial direction, is formed between an outer peripheral surface 30*a* of the valve element 30 and an inner peripheral surface 20*a* of the nozzle body 20. This flow passage will be referred to as a downstream flow passage F30. A seat surface 30*s* is formed at an end portion of the valve element 30 located on the injection hole 23*a* side, and the seat surface 30*s* is in a ring form and can be seated against and lifted away from the seatable surface 23*s*.

A coupling member 31 is joined to a counter-injection-hole side end portion of the valve element 30, which is opposite to the injection hole 23*a*, by for example, welding. Furthermore, an orifice member 32 and the movable core 41 are installed to a counter-injection-hole side end portion of the coupling member 31.

Figure 2:
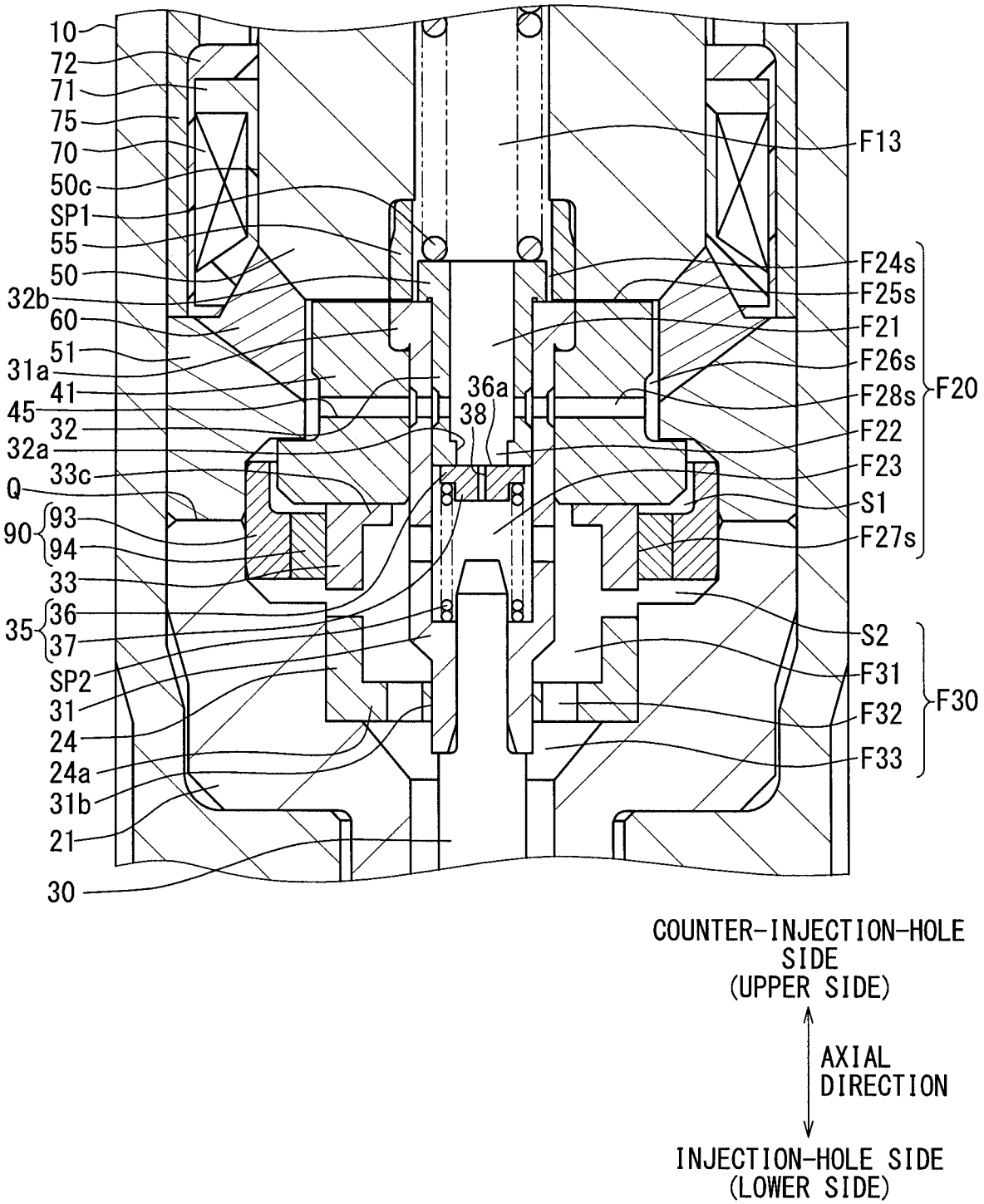
FIG. 2 is an enlarged view showing an area around a movable core shown in FIG. 1.
Figure 3:
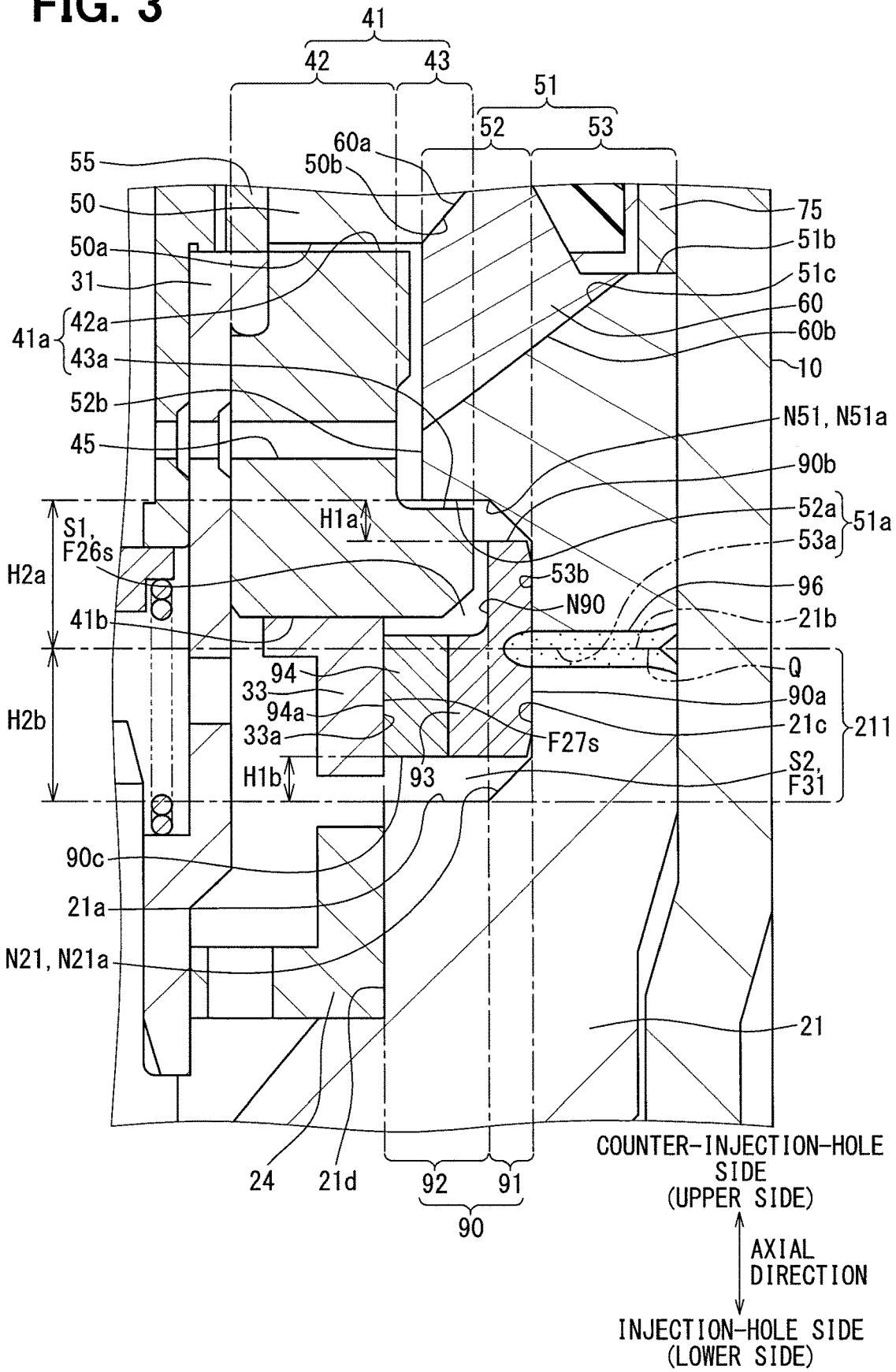
FIG. 3 is an enlarged view of an area around a cover body shown in FIG. 1.

As shown in FIGS. 2 and 3, the coupling member 31 is shaped into a cylindrical tubular form and extends in the axial direction while an inside of the coupling member 31 serves as a flow passage F23 that conducts the fuel. The orifice member 32 is fixed to a cylindrical inner peripheral surface of the coupling member 31 by, for example, welding. The movable core 41 is fixed to a cylindrical outer peripheral surface of the coupling member 31 by, for example, welding. An enlarged diameter portion 31*a*, a diameter of which is increased in the radial direction, is formed at the counter-injection-hole side end portion of the coupling member 31. An injection-hole-side end surface of the enlarged diameter portion 31*a* is engaged with the movable core 41, so that removal of the coupling member 31 from the movable core 41 toward the injection-hole side is limited.

The orifice member 32 is shaped into a cylindrical tubular form and extends in the axial direction while an inside of the orifice member 32 serves as a flow passage F21 that conducts the fuel. An orifice 32*a* is formed at an injection-hole-side end portion of the orifice member 32. A passage cross-sectional area of a portion of the flow passage F21 at the orifice 32*a* is partially narrowed, so that the orifice 32*a* serves as a flow restricting portion that restricts a flow rate of the fuel. The portion of the flow passage F21, at which the passage cross-sectional area is narrowed by the orifice 32*a*, is referred to as a restricting flow passage F22.

The restricting flow passage F22 is located along a central axis of the valve element 30. A passage length of the restricting flow passage F22 is smaller than a diameter of the restricting flow passage F22. An enlarged diameter portion 32*b*, which is enlarged in the radial direction, is formed at the counter-injection-hole side end portion of the orifice member 32. An injection-hole-side end surface of the enlarged diameter portion 32*b* is engaged with the coupling member 31, so that removal of the orifice member 32 from the coupling member 31 toward the injection-hole side is limited.

The movable structure M includes a movable member 35 and a resilient urging member SP2. The movable member 35 is placed in the flow passage F23 at the inside of the coupling member 31 such that the movable member 35 is movable in the axial direction relative to the orifice member 32.

The movable member 35 is shaped into a cylindrical columnar form extending in the axial direction and is made of metal, and the movable member 35 is placed on the downstream side of the orifice member 32. A through-hole extends through a center part of the movable member 35 in the axial direction. This through-hole is a portion of the flow passage F and is communicated with the restricting flow passage F22, and this through-hole serves as a sub-restricting passage 38 that has a passage cross-sectional area, which is smaller than the passage cross-sectional area of the restricting flow passage F22. The movable member 35 includes a seal portion 36 and an engaging portion 37. The seal portion 36 has a seal surface 36*a* that is configured to cover the restricting flow passage F22. The engaging portion 37 is engaged with the resilient urging member SP2.

A diameter of the engaging portion 37 is smaller than a diameter of the seal portion 36, and a resilient urging member SP2, which is shaped in a form of a coil, is fitted to the engaging portion 37. In this way, movement of the resilient urging member SP2 in the radial direction is limited by the engaging portion 37. One end of the resilient urging member SP2 is supported by a lower end surface of the seal portion 36, and the other end of the resilient urging member SP2 is supported by the coupling member 31. The resilient urging member SP2 is resiliently deformed in the axial direction to apply a resilient force against the movable member 35, and the seal surface 36*a* of the movable member 35 is urged against the lower end surface of the orifice member 32 by the resilient force of the resilient urging member SP2.

The movable core 41 is an annular member made of metal. The movable core 41 includes a movable inside 42 and a movable outside 43, which are respectively shaped into an annular form. The movable inside 42 forms an inner peripheral surface of the movable core 41, and the movable outside 43 is placed on the radially outer side of the movable inside 42. The movable core 41 includes a movable upper surface 41*a* that faces the counter-injection-hole side and is formed at an upper end surface of the movable core 41. A step is formed at the movable upper surface 41*a*. Specifically, the movable outside 43 has a movable outside upper surface 43*a* that faces the counter-injection-hole side, and the movable inside 42 has a movable inside upper surface 42*a* that faces the counter-injection-hole side. The movable outside upper surface 43*a* is placed on the injection-hole side of the movable inside upper surface 42*a*, so that the step is formed at the movable upper surface 41*a*. The movable inside upper surface 42*a* and the movable outside upper surface 43*a* extend perpendicular to the axial direction.

The movable core 41 has a movable lower surface 41*b* that faces the injection-hole side. The movable lower surface 41*b* extends over the movable inside 42 and the movable outside 43 in the radial direction and thereby forms a planar lower end surface of the movable core 41. At the movable lower surface 41*b*, there is no step at a boundary between the movable inside 42 and the movable outside 43. In the axial direction, a height of the movable outside 43 is smaller than a height of the movable inside 42, and thereby the movable core 41 is shaped such that the movable outside 43 projects from the movable inside 42 toward the radially outer side.

The movable core 41 is movable integrally with the coupling member 31, the valve element 30, the orifice member 32 and a slide member 33 in the axial direction. The movable core 41, the coupling member 31, the valve element 30, the orifice member 32 and the slide member 33 collectively serve as a movable structure M that is configured to move integrally in the axial direction.

The slide member 33 is formed separately from the movable core 41 but is fixed to the movable core 41 by, for example, welding. By making the slide member 33 separately from the movable core 41, it is possible to easily realize a structure, in which the slide member 33 and the movable core 41 are made of different materials, respectively. A material of the movable core 41 has a higher degree of magnetism in comparison to a material of the slide member 33, and the material of the slide member 33 has higher wear resistance in comparison to the material of the movable core 41.

The slide member 33 is shaped into a cylindrical tubular form, and a cylindrical outer peripheral surface of the slide member 33 serves as a slide surface 33*a* that is slidable relative to a member at the nozzle body 20 side. A counter-injection-hole side surface of the slide member 33 is joined to an injection-hole-side surface of the movable core 41 by, for example, welding such that the fuel does not pass through a gap between the slide member 33 and the movable core 41. A reduced diameter portion 33*c*, a diameter of which is reduced in the radial direction, is formed at a counter-injection-hole side end portion of the slide member 33. A support member 24 is fixed to the body main portion 21, and a reduced diameter portion 24*a*, a diameter of which is reduced in the radial direction, is formed at the support member 24. The slide member 33 and the support member 24 are arranged one after the other in the axial direction. A separation distance between the slide member 33 and the support member 24 is increased or decreased in response to movement of the movable structure M. This separation distance is minimized in a valve closing state of the valve element 30, in which the valve element 30 closes the injection hole. However, even in this state, the slide member 33 is spaced from the support member 24 toward the counter-injection-hole side.

The movable structure M includes guide portions that enable slide movement of the movable structure M along the nozzle body 20 in the axial direction and support the movable structure M relative to the nozzle body 20 in the radial direction. The guide portions are provided at two axial locations, respectively. One of the guide portions, which is located on the injection hole 23*a* side in the axial direction, is referred to as an injection-hole-side guide portion 30*b* (see FIG. 1), and the other one of the guide portions, which is located on the counter-injection-hole side, is referred to as a counter-injection-hole-side guide portion 31*b*. The injection-hole-side guide portion 30*b* is formed at an outer peripheral surface of the valve element 30 and is slidably supported by an inner peripheral surface of the injection hole member 23. The counter-injection-hole-side guide portion 31*b* is formed at an outer peripheral surface of the coupling member 31 and is slidably supported by an inner peripheral surface of the support member 24.

The stationary cores 50, 51 are fixed in the inside of the case 10. The stationary cores 50, 51 are respectively shaped into a ring form that circumferentially extends about the axis, and the stationary cores 50, 51 are made of metal. The first stationary core 50 is placed on the radially inner side of the coil 70 such that an outer peripheral surface of the first stationary core 50 is opposed to an inner peripheral surface of the coil 70. The first stationary core 50 has a first lower surface 50*a* that faces the injection-hole side, and the first lower surface 50*a* forms a lower end surface of the first stationary core 50 and is perpendicular to the axial direction. The first stationary core 50 is placed on the counter-injection-hole side of the movable core 41, and the first lower surface 50*a* is opposed to the movable inside upper surface 42*a* of the movable core 41. The first stationary core 50 includes a first tilt surface 50*b* and a first outer surface 50*c*. The first tilt surface 50*b* obliquely extends from a radially outer end portion of the first lower surface 50*a* toward the counter-injection-hole side. The first outer surface 50*c* is an outer peripheral surface of the first stationary core 50 and extends from a counter-injection-hole side upper end portion of the first tilt surface 50*b* in the axial direction. The first stationary core 50 is shaped such that an outer corner between the first lower surface 50*a* and the first outer surface 50*c* is chambered to form the first tilt surface 50*b*.

The second stationary core 51 is placed on the injection-hole side of the coil 70 and is shaped into an annular form as a whole. The second stationary core 51 includes a second inside 52 and a second outside 53, which are respectively shaped into an annular form. The second outside 53 forms an outer peripheral surface of the second stationary core 51, and the second inside 52 is placed on the radially inner side of the second outside 53. The second stationary core 51 includes a second lower surface 51*a*, which faces the injection-hole side, and the second lower surface 51*a* forms a lower end surface of the second stationary core 51 and is perpendicular to the axial direction. A step is formed at the second lower surface 51*a*. Specifically, the second inside 52 has a second inside lower surface 52*a* that faces the injection-hole side, and the second outside 53 has a second outside lower surface 53*a* that faces the injection-hole side. The second inside lower surface 52*a* is placed on the counter-injection-hole side of the second outside lower surface 53*a*, so that the step is formed at the second lower surface 51*a*. In the axial direction, a height of the second inside 52 is smaller than a height of the second outside 53, and thereby the second stationary core 51 is shaped such that the second inside 52 projects from the second outside 53 toward the radially inner side.

The second inside 52 of the second stationary core 51 is placed on the counter-injection-hole side of the movable outside 43 of the movable core 41, and the second inside 52 and the movable outside 43 are placed one after the other in the axial direction. In this case, the second inside lower surface 52*a* and the movable outside upper surface 43*a* are opposed to each other in the axial direction.

At the second stationary core 51, the second outside 53 is placed on the counter-injection-hole side of the body main portion 21. The body main portion 21 includes an outside projection 211, which is shaped into an annular form and extends from the radially outer end portion of the body main portion 21 toward the counter-injection-hole side. The outside projection 211 is spaced from a radially inner end portion of the upper end surface of the body main portion 21, so that a step is formed at the upper end surface of the body main portion 21. The body main portion 21 includes a main portion inside upper surface 21*a*, a main portion outside upper surface 21*b*, a main portion outside inner surface 21*c* and a main portion inside inner surface 21*d*. The main portion inside upper surface 21*a* and the main portion outside upper surface 21*b* face the counter-injection-hole side, and the main portion outside inner surface 21*c* and the main portion inside inner surface 21*d* face the radially inner side. The main portion outside upper surface 21*b* is an upper end surface of the outside projection 211, and the main portion outside inner surface 21*c* is an inner peripheral surface of the outside projection 211. The main portion inside inner surface 21*d* extends from a radially inner end portion of the main portion inside upper surface 21*a* toward the injection-hole side and is an inner peripheral surface of the body main portion 21. The main portion inside upper surface 21*a* is a portion of the upper end surface of the body main portion 21, which is located on the radially inner side of the main portion outside inner surface 21*c*. The main portion inside upper surface 21*a* and the main portion outside upper surface 21*b* are perpendicular to the axial direction, and the main portion outside inner surface 21*c* extends in parallel with the axial direction.

At the second stationary core 51, the second outside lower surface 53*a* is overlapped with the main portion outside upper surface 21*b*, and the second stationary core 51 and the body main portion 21 are joined together by, for example, laser welding at this overlapped portion. In a state before the welding, the second outside lower surface 53*a* and the main portion outside upper surface 21*b* are included in a stationary boundary Q, which is a boundary between the second stationary core 51 and the body main portion 21. A width of the second outside lower surface 53*a* and a width of the main portion outside upper surface 21*b*, which are measured in the radial direction, are set to be equal to each other, and the second outside lower surface 53*a* and the main portion outside upper surface 21*b* are entirely overlapped with each other. An outer peripheral surface of the second outside 53 and an outer peripheral surface of the body main portion 21 are overlapped with the inner peripheral surface of the case 10.

The second stationary core 51 includes a second upper surface 51*b* and a second tilt surface 51*c*. The second tilt surface 51*c* obliquely extends from a second inside inner surface 52*b*, which is an inner peripheral surface of the second inside 52, toward the counter-injection-hole side, and the second upper surface 51*b* extends from an upper end portion of the second tilt surface 51*c* in the radial direction. In this case, the second upper surface 51*b* and the second tilt surface 51*c* form an upper end surface of the second stationary core 51. The second tilt surface 51*c* extends along both of the second inside 52 and the second outside 53 in the radial direction. The second stationary core 51 is shaped such that an outer corner between the second upper surface 51*b* and the second inside inner surface 52*b* is chambered to form the second tilt surface 51*c*.

The non-magnetic member 60 is a metal member that is shaped into a ring form and circumferentially extends about the axis, and the non-magnetic member 60 is placed between the first stationary core 50 and the second stationary core 51. A degree of magnetism of the non-magnetic member 60 is lower than a degree of magnetism of each stationary core 50, 51 and the degree of magnetism of the movable core 41 and is made of, for example, a non-magnetic material. Similar to the non-magnetic member 60, a degree of magnetism of the body main portion 21 is lower than the degree of magnetism of each stationary core 50, 51 and the degree of magnetism of the movable core 41, and the body main portion 21 is made of, for example, a non-magnetic material. In contrast, each of the stationary cores 50, 51 and the movable core 41 has the relatively high degree of magnetism and is made of, for example, a ferromagnetic material.

The stationary cores 50, 51 and the movable core 41 may be referred to as magnetic flux passage members, which are likely to be a passage of the magnetic flux, and the non-magnetic member 60 and the body main portion 21 may be referred to as magnetic flux limiting members, which are hard to become a passage of the magnetic flux. Particularly, the non-magnetic member 60 has a function of limiting occurrence of short-circuiting of the magnetic flux between the stationary cores 50, 51 without passing through the movable core 41, and the non-magnetic member 60 may be referred to as a short-circuit limiting member. Furthermore, the non-magnetic member 60 thereby forms a short-circuit limiting portion. The body main portion 21 and the nozzle portion 22 are integrally formed in one piece from the metal at the nozzle body 20, so that the body main portion 21 and the nozzle portion 22 have the relatively low degree of magnetism.

The non-magnetic member 60 includes an upper tilt surface 60*a* and a lower tilt surface 60*b*. The upper tilt surface 60*a* is overlapped with a first tilt surface 50*b* of the first stationary core 50, and the upper tilt surface 60*a* and the first tilt surface 50*b* are joined together by welding. The lower tilt surface 60*b* is overlapped with the second tilt surface 51*c* of the second stationary core 51, and the lower tilt surface 60*b* and the second tilt surface 51*c* are joined together by welding. At least a portion of the first tilt surface 50*b* and at least a portion of the second tilt surface 51*c* are arranged one after the other in the axial direction, and the non-magnetic member 60 is interposed between the tilt surfaces 50*b*, 51*c* at least in the axial direction.

A stopper 55, which is shaped into a cylindrical tubular form and is made of metal, is fixed to the inner peripheral surface of the first stationary core 50. The stopper 55 is a member that limits movement of the movable structure M toward the counter-injection-hole side through contact of the stopper 55 against the coupling member 31 of the movable structure M. When a lower end surface of the stopper 55 contacts an upper end surface of the enlarged diameter portion 31*a* of the coupling member 31, the movement of the movable structure M is limited. The stopper 55 projects from the first stationary core 50 toward the injection-hole side. Therefore, even in the state where the movement of the movable structure M is limited by the stopper 55, a predetermined gap is formed between the movable core 41 and each of the stationary cores 50, 51. In this case, the gap is formed between the first lower surface 50*a* and the movable inside upper surface 42*a*, and the other gap is formed between the second inside lower surface 52*a* and the movable outside upper surface 43*a*. In FIG. 3 and the like, for the sake of clear indication of these gaps, a separation distance between the first lower surface 50*a* and the movable inside upper surface 42*a* and a separation distance between the second inside lower surface 52*a* and the movable outside upper surface 43*a* are exaggerated from the real separation distances.

The coil 70 is placed on the radially outer side of the non-magnetic member 60 and the stationary core 50. The coil 70 is wound around a bobbin 71 made of resin. The bobbin 71 is a shaped into a cylindrical tubular form that is cylindrical about the axis. Therefore, the coil 70 is in a ring form that circumferentially extends about the axis. The bobbin 71 contacts the first stationary core 50 and the non-magnetic member 60. A radially-outer-side opening portion, an upper end surface and a lower end surface of the bobbin 71 are covered by a cover 72 made of resin.

A yoke 75 is placed between the cover 72 and the case 10. The yoke 75 is placed on the counter-injection-hole side of the second stationary core 51 and contacts the second upper surface 51*b* of the second stationary core 51. Like the stationary cores 50, 51 and the movable core 41, the yoke 75 has a relatively high degree of magnetism and is made of, for example, a ferromagnetic material. The stationary cores 50, 51 and the movable core 41 form the flow passage of the fuel and are thereby placed at a location where the stationary cores 50, 51 and the movable core 41 contact the fuel. Thus, the stationary cores 50, 51 and the movable core 41 are made to be oil-resistant. In contrast, the yoke 75 does not form the flow passage and is thereby placed at a location where the yoke 75 does not contact the fuel. Therefore, the yoke 75 is not made to be oil-resistant. As a result, the degree of magnetism of the yoke 75 is higher than the degree of magnetism of each stationary core 50, 51 and the degree of magnetism of the movable core 41.

In the present embodiment, a cover body 90, which covers the stationary boundary Q between the second stationary core 51 and the body main portion 21, is placed on the radially inner side of the second stationary core 51 and the body main portion 21. The cover body 90 is in a ring form and entirely covers the stationary boundary Q in the circumferential direction of the second stationary core 51. The cover body 90 projects from the second stationary core 51 and the body main portion 21 toward the radially inner side in a state where the cover body 90 is placed across the stationary boundary Q in the axial direction. The body main portion 21 includes a main portion cutout N21, and the second stationary core 51 includes a second cutout N51. The cover body 90 is inserted in these cutouts N21, N51.

At the body main portion 21, the main portion cutout N21 is formed by the main portion outside inner surface 21*c* and the main portion inside upper surface 21*a*. The main portion cutout N21 opens toward the injection-hole side in the axial direction and also opens toward the radially inner side. The main portion cutout N21 has a cutout tilt surface N21*a* that connects between the main portion outside inner surface 21*c* and the main portion inside upper surface 21*a*, and the cutout tilt surface N21*a* makes an inner corner of the main portion cutout N21 in a chamfered form.

At the second stationary core 51, the second cutout N51 is formed by the second inside lower surface 52*a* and the second outside inner surface 53*b*. The second outside inner surface 53*b* extends in the axial direction in a state where the second outside inner surface 53*b* faces the radially inner side and thereby forms an inner peripheral surface of the second outside 53. The second cutout N51 is formed by the step of the second lower surface 51*a* of the second stationary core 51 such that the second cutout N51 opens toward the counter-injection-hole side in the axial direction and also opens toward the radially inner side. The second cutout N51 has a cutout tilt surface N51*a* that connects between the second inside lower surface 52*a* and the second outside inner surface 53*b*, and the cutout tilt surface N51*a* makes an inner corner of the second cutout N51 in a chamfered form.

The main portion cutout N21 and the second cutout N51 are communicated with each other in the axial direction. At the cutouts N21, N51, the cover body 90 is placed between the second inside lower surface 52*a* and the main portion inside upper surface 21*a*. The main portion outside inner surface 21*c* of the body main portion 21 and the second outside inner surface 53*b* of the second stationary core 51 are flush with each other in the axial direction. A cover outer surface 90*a*, which is an outer peripheral surface of the cover body 90, overlaps with both of the main portion outside inner surface 21*c* and the second outside inner surface 53*b* in a state where the cover outer surface 90*a* covers the stationary boundary Q from the inner side. However, the cover outer surface 90*a* does not overlap with the cutout tilt surfaces N21*a*, N51*a*.

The cover body 90 includes a cover inside 92 and a cover outside 91. The cover outside 91 forms the cover outer surface 90*a*, and the cover inside 92 is placed on the radially inner side of the cover outside 91. A height H1 of the cover inside 92 is smaller than a height H2 of the cover outside 91 (see FIG. 4). The cover body 90 includes a cover upper surface 90*b*, which faces the counter-injection-hole side, and a cover lower surface 90*c*, which faces the injection-hole side. A surface area of the cover upper surface 90*b* is the same as a surface area of the cover lower surface 90*c*.

A counter-injection-hole side upper end surface of the cover inside 92 is placed on the injection-hole side of a counter-injection-hole side upper end surface of the cover outside 91, so that a step is formed at the cover upper surface 90*b*. The cover lower surface 90*c* forms a planar injection-hole-side lower end surface of the cover body 90, and a step is not formed at a boundary between the cover inside 92 and the cover outside 91.

A cover cutout N90 is formed at the cover body 90 by the step formed at the cover upper surface 90*b*. An outer corner of the movable core 41, which is on the injection-hole side and is on the radially outer side, is inserted into the cover cutout N90. In this case, a counter-injection-hole-side end portion of the cover outside 91 is placed between the movable outside and the second outside 53 in the radial direction. Furthermore, the cover inside 92 is placed on the injection hole side of the second outside 53 in the axial direction.

At the cover body 90, the cover upper surface 90*b* is spaced from the movable lower surface 41*b* of the movable core 41 and the second inside lower surface 52*a* of the second stationary core 51 toward the injection-hole side, and the cover lower surface 90*c* is spaced from the main portion inside upper surface 21*a* of the body main portion 21 toward the counter-injection-hole side. The cover outside 91 is interposed between the second outside 53 and the movable outside 43 in the radial direction, and the cover inside 92 is interposed between the movable core 41 and the main portion inside upper surface 21*a* in the axial direction.

As shown in FIG. 3, a separation distance H1*a*, which is measured between the cover upper surface 90*b* and the second inside lower surface 52*a* in the axial direction, is the same as a separation distance H1*b*, which is measured between the cover lower surface 90*c* and the main portion inside upper surface 21*a* in the axial direction. Furthermore, a separation distance H2*a*, which is measured between the stationary boundary Q and the second inside lower surface 52*a* in the axial direction, is the same as a separation distance H2*b*, which is measured between the stationary boundary Q and the main portion inside upper surface 21*a* in the axial direction. In these cases, the cover outside 91 and the stationary boundary Q are placed at a center position between the second inside lower surface 52*a* and the main portion inside upper surface 21*a* in the axial direction.

In FIGS. 2 and 3, although a separation distance between the cover inside 92 and the movable core 41 in the axial direction is increased or decreased in response to movement of the movable structure M, the cover inside 92 and the movable core 41 do not contact with each other when the valve element 30 is seated against the seatable surface 23*s*. In the present embodiment, a space, which is defined by the cover upper surface 90*b*, the movable core 41 and the second stationary core 51, is referred to as a cover upper chamber S1, and a space, which is defined between the cover lower surface 90*c* and the body main portion 21, is referred to as a cover lower chamber S2. The cover upper chamber S1 and the cover lower chamber S2 are formed by placing the cover body 90 into the main portion cutout N21 and the second cutout N51. The cover upper chamber S1 is included in the flow passage F26*s*, and the cover lower chamber S2 is included in the flow passage F31.

The cover body 90 is formed by a cover member 93 and an opposing member 94. The cover member 93 and the opposing member 94 are annular members made of metal. The opposing member 94 is placed on the radially inner side of the cover member 93. The opposing member 94 is fitted to the inner peripheral surface of the cover member 93, and the opposing member 94 and the cover member 93 are joined together by, for example, welding at a boundary between the opposing member 94 and the cover member 93. The cover member 93 includes an outer peripheral surface side portion, which is included in the cover outside 91, and an inner peripheral surface side portion, which is included in the cover inside 92. In contrast, the opposing member 94 is entirely included in the cover inside 92. The opposing member 94 forms an opposing portion and is supported by the cover member 93.

The opposing member 94 includes an opposing inner surface 94*a* and is placed on the radially outer side of the slide member 33. The opposing inner surface 94*a* is opposed to the slide surface 33*a* of the slide member 33 in the radial direction, and the slide surface 33*a* of the slide member 33 is slidable along the opposing inner surface 94*a*. In this case, the above-described member, which is provided at the nozzle body 20 side and along which the slide surface 33*a* is slidable, is the opposing member 94. The opposing inner surface 94*a* is an inner peripheral surface of the opposing member 94, and a height of the opposing inner surface 94*a*, which is measured in the axial direction, is smaller than a height of the slide surface 33*a*, which is measured in the axial direction. The opposing inner surface 94*a* and the slide surface 33*a* both extend in parallel with the axial direction. A diameter of the slide surface 33*a* is slightly smaller than a diameter of the opposing inner surface 94*a*. Specifically, a position of the slide surface 33*a* in a direction perpendicular to a sliding direction of the slide member 33 is on the radially inner side, i.e., on the center line C side of a radially outermost position of the opposing inner surface 94*a*.

The slide member 33 is slid along the opposing member 94, so that the opposing member 94 also serves as a guide portion that guides the moving direction of the movable structure M. In this case, the opposing inner surface 94*a* may be also referred to as a guiding surface or a guide surface. The opposing member 94 forms a guiding portion.

Like the non-magnetic member 60 and the body main portion 21, a degree of magnetism of the cover member 93 and a degree of magnetism of the opposing member 94 are lower than the degree of magnetism of each stationary core 50, 51 and the degree of magnetism of the movable core 41, and the cover member 93 and the opposing member 94 are made of, for example, a non-magnetic material. Therefore, the cover member 93 and the opposing member 94 are hard to become a passage of the magnetic flux. However, desirably the opposing member 94 is made of a material, which has a high hardness and a high strength, to limit wearing and deformation of the opposing inner surface 94*a* at the time of sliding the slide member 33 along the opposing member 94. In the present embodiment, the high hardness and the high strength of the material of the opposing member 94 are prioritized, and thereby the opposing member 94 is more magnetic than the cover member 93, the non-magnetic member 60 and the body main portion 21. In this case, the opposing member 94 is more likely to be a passage of the magnetic flux in comparison to the cover member 93 or the like. However, the degree of magnetism of the opposing member 94 is lower than the degree of magnetism of each stationary core 50, 51 and the degree of magnetism of the movable core 41, so that the opposing member 94 is less likely to be a passage of the magnetic flux in comparison to the stationary cores 50, 51 or the like.

As discussed above, the stationary boundary Q includes the welded portion, at which the second stationary core 51 and the body main portion 21 are welded together, and this portion will be referred to as a welding portion 96. The welding portion 96 is located in a range that is from an outside end portion of the stationary boundary Q to a predetermined depth in the radial direction. Besides the portion of the second stationary core 51 and the portion of the body main portion 21, the welding portion 96 also includes a portion of the cover body 90. With respect to the cover body 90, a portion of the cover member 93, which forms the cover outside 91 of the cover member 93, is included in the welding portion 96. The depth of the welding portion 96 in the radial direction is larger than a width of the stationary boundary Q by the amount that corresponds to a depth of the portion of the cover member 93 in the radial direction. The welding portion 96 is a solidified portion that is formed such that the portion of the second stationary core 51, the portion of the body main portion 21 and the portion of the cover member 93 are molten and mixed through the heating and are solidified through cooling to form the solidified portion. At the welding portion 96, the three members, i.e., the second stationary core 51, the body main portion 21 and the cover member 93 are joined together.

The welding portion 96 is indicated by halftone dots in FIG. 3, and the stationary boundary Q is indicated an imaginary line in FIG. 3. In contrast, in FIG. 2 and the other drawings, which are other than FIG. 3, the indication the welding portion 96 is omitted for the sake of simplicity. However, in reality, as shown in FIG. 3, the portion of the second stationary core 51, the portion of the body main portion 21, the portion of the cover member 93 and the stationary boundary Q are lost through the formation of the welding portion 96. Therefore, in reality, the cover body 90 covers the welding portion 96 from the radially inner side instead of the stationary boundary Q. However, in the present embodiment, the covering of the welding portion 96 by the cover body 90 and the covering of the stationary boundary Q by the cover body 90 are synonyms to each other.

Referring back to FIG. 1, the pipe connecting portion 80, which forms the flow inlet 80*a* of the fuel and is connected to an external pipe, is placed on the counter-injection-hole side of the first stationary core 50. The pipe connecting portion 80 is made of metal and is formed by a metal member that is formed integrally with the stationary core 50 in one piece. The fuel, which is pressurized by the high pressure pump, is supplied to the fuel injection valve 1 through the flow inlet 80*a*. A flow passage F11 of the fuel, which extends in the axial direction, is formed in an inside of the pipe connecting portion 80, and a press-fitting member 81 is securely press fitted into the flow passage F11.

A resilient member SP1 is placed on the injection-hole side of the press-fitting member 81. One end of the resilient member SP1 is supported by the press-fitting member 81, and the other end of the resilient member SP1 is supported by the enlarged diameter portion 32*b* of the orifice member 32. Therefore, the amount of resilient deformation of the resilient member SP1 at the valve opening time of the valve element 30, at which the valve element 30 is lifted to a full lift position, i.e., at the time of contacting of the coupling member 31 to the stopper 55, is specified according to the amount of press fitting of the press-fitting member 81, i.e., a fixation position of the press-fitting member 81 in the axial direction. Specifically, a valve closing force, which is a set load of the resilient member SP1, is adjusted by the amount of press fitting of the press-fitting member 81.

A fixation member 83 is placed at an outer peripheral surface of the pipe connecting portion 80. A threaded portion, which is formed at an outer peripheral surface of the fixation member 83, is threadably engaged with a threaded portion, which is formed at an inner peripheral surface of the case 10, so that the fixation member 83 is fixed to the case 10. The pipe connecting portion 80, the stationary cores 50, 51, the non-magnetic member 60 and the body main portion 21 are clamped between a bottom surface of the case 10 and the fixation member 83 by an axial force that is generated by the fixation of the fixation member 83 to the case 10.

The pipe connecting portion 80, the stationary core 50, the non-magnetic member 60, the nozzle body 20 and the injection hole member 23 collectively serve as a body B that has a flow passage F. The flow passage F conducts the fuel received through the flow inlet 80*a* to the injection hole 23*a*. It can be said that the movable structure M described above is slidably received in the inside of the body B.

Next, an operation of the fuel injection valve 1 will be described.

When the coil 70 is energized, a magnetic field is generated around the coil 70. For example, as indicated by a dotted line in FIG. 4, a magnetic circuit, along which the magnetic flux flows, is formed through the stationary cores 50, 51, the movable core 41 and the yoke 75 in response to the energization, so that the movable core 41 is attracted to the stationary cores 50, 51 by a magnetic force generated by the magnetic circuit. In this case, the first lower surface 50*a* and the movable inside upper surface 42*a* become the passage of the magnetic flux, so that the first stationary core 50 and the movable core 41 are attracted to each other. Likewise, the second inside lower surface 52*a* and the movable outside upper surface 43*a* become the passage of the magnetic flux, so that the second stationary core 51 and the movable core 41 are attracted to each other. Therefore, the first lower surface 50*a*, the movable inside upper surface 42*a*, the second inside lower surface 52*a* and the movable outside upper surface 43*a* can be respectively referred to as an attractive surface. Particularly, the movable inside upper surface 42*a* serves as a first attractive surface, and the movable outside upper surface 43*a* serves as a second attractive surface.

The non-magnetic member 60 does not become the passage of the magnetic flux, so that the magnetic short circuiting between the first stationary core 50 and the second stationary core 51 is limited. An attractive force between the movable core 41 and the first stationary core 50 is generated by a magnetic flux, which passes through the movable inside upper surface 42*a* and the first lower surface 50*a*, and the attractive force between the movable core 41 and the second stationary core 51 is generated by the magnetic flux, which passes through the movable outside upper surface 43*a* and the second lower surface 51*a*. The magnetic flux, which passes through the stationary cores 50, 51 and the movable core 41, includes the magnetic flux, which passes through not only the yoke 75 but also the case 10.

Furthermore, since the degree of magnetism of the body main portion 21 and the degree of magnetism of the cover body 90 are lower than the degree of magnetism of each stationary core 50, 51, the flow of the magnetic flux through the body main portion 21 and the cover body 90 is limited. As described above, the high hardness and the high strength of the opposing member 94 are prioritized to withstand the sliding of the slide member 33 along the opposing member 94, and thereby the opposing member 94 becomes more magnetic. However, since the degree of magnetism of the cover member 93 is sufficiently low, the cover member 93 limits the magnetic flux from passing through the second stationary core 51 to reach the opposing member 94.

In addition to the attractive force generated by the magnetic flux described above, the valve closing force, which is exerted by the resilient member SP1, the valve closing force, which is exerted by the fuel pressure, and the valve opening force, which is exerted by the magnetic force described above, are applied to the movable structure M. The valve opening force is set to be larger than these valve closing forces. Therefore, when the magnetic force is generated in response to the energization, the movable core 41 is moved together with the valve element 30 toward the counter-injection-hole side. In this way, the valve element 30 makes the valve opening movement, so that the seat surface 30*s* is lifted away from the seatable surface 23*s*, and thereby the high pressure fuel is injected from the injection hole 23*a*.

When the energization of the coil 70 is stopped, the valve opening force, which is generated by the magnetic force described above, is lost. Therefore, the valve element 30 makes the valve closing movement together with the movable core 41 by the valve closing force of the resilient member SP1, so that the seat surface 30*s* is seated against the seatable surface 23*s*. In this way, the valve element 30 makes the valve closing movement, and thereby the fuel injection from the injection hole 23*a* is stopped.

Next, the flow of the fuel at the time of injecting the fuel from the injection hole 23*a* will be described with reference to FIGS. 1 and 2.

The high pressure fuel, which is supplied from the high pressure pump to the fuel injection valve 1, is inputted into the flow inlet 80*a* and flows through the flow passage F11, which is along the cylindrical inner peripheral surface of the pipe connecting portion 80, the flow passage F12, which is along the cylindrical inner peripheral surface of the press-fitting member 81, and the flow passage F13, in which the resilient member SP1 is received (see FIG. 1). These flow passages F11, F12, F13 are collectively referred to as an upstream flow passage F10. In the flow passage F formed in the inside of the fuel injection valve 1, the upstream flow passage F10 is located at the outside of the movable structure M and is on the upstream side of the movable structure M. Furthermore, in the flow passage F, a flow passage, which is formed by the movable structure M, will be referred to as a movable flow passage F20, and a flow passage, which is located on the downstream of the movable flow passage F20, will be referred to as a downstream flow passage F30.

The movable flow passage F20 conducts the fuel outputted from the flow passage F13 to a main passage and a sub-passage. The main passage and the sub-passage are independently arranged. Specifically, the main passage and the sub-passage are arranged in parallel, and the fuel, which flows through the main passage, and the fuel, which flows in the sub-passage, are merged at the downstream flow passage F30.

The main passage is a passage that conducts the fuel through the flow passage F21, which is along the cylindrical inner peripheral surface of the orifice member 32, the restricting flow passage F22, which is defined by the orifice 32*a*, and the flow passage F23, which is along the cylindrical inner peripheral surface of the coupling member 31, in this order. Thereafter, the fuel of the flow passage F23 flows via through-holes, which radially extend through the coupling member 31, and then the fuel flows into the flow passage F31 of the downstream flow passage F30, which is along the cylindrical outer peripheral surface of the coupling member 31. The downstream flow passage F30 includes a cover lower chamber S2 located on the injection-hole side of the cover body 90, and the cover lower chamber S2 is communicated with a gap between the support member 24 and the slide member 33.

The sub-passage is a passage that conducts the fuel through a flow passage F24*s*, which is along the cylindrical outer peripheral surface of the orifice member 32, a flow passage F25*s*, which is a gap between the movable core 41 and the stationary core 50, a flow passage F26*s*, which extends on the radially outer side of the movable core 41, and a slide flow passage F27*s*, which is along the slide surface 33*a*, in this order. The flow passage F26*s* includes a cover upper chamber S1, which is placed on the counter-injection-hole side of the cover body 90. The flow passage F26*s* includes an interspace defined by the movable core 41 relative to the first stationary core 50, the non-magnetic member 60, the second stationary core 51 and the cover body 90. In the flow passage F26*s*, an interspace between the first lower surface 50*a* and the movable inside upper surface 42*a* and an interspace between the second inside lower surface 52*a* and the movable outside upper surface 43*a* are also included in the gap between the movable core 41 and the stationary core 50. The sub-passage is defined between the body main portion 21 and the movable structure M, and the body main portion 21 serves as a passage forming portion, which forms the sub-passage.

The slide flow passage F27*s* may be referred to as a separate flow passage, and the fuel of the slide flow passage F27*s* flows into the flow passage F31 of the downstream flow passage F30, which is along the cylindrical outer peripheral surface of the coupling member 31. A passage cross-sectional area of the slide flow passage F27*s* is smaller than a passage cross-sectional area of the flow passage F26*s*, which extends on the radially outer side of the movable core 41. Specifically, a degree of flow restriction of the slide flow passage F27*s* is set to be larger than a degree of flow restriction of the flow passage F26*s*.

Here, an upstream portion of the sub-passage is connected to a portion that is on the upstream side of the restricting flow passage F22. A downstream portion of the sub-passage is connected to a downstream portion of the restricting flow passage F22. Specifically, the sub-passage connects between the upstream portion of the restricting flow passage F22 and the downstream portion of the restricting flow passage F22 while the sub-passage bypasses the restricting flow passage F22.

The fuel, which flows from the flow passage F13 of the upstream flow passage F10 into the movable flow passage F20, is branched into the flow passage F21, which forms an upstream end of the main passage, and a flow passage F24*s*, which forms an upstream end of the sub-passage, and the branched flows of the fuel are thereafter merged at the flow passage F31 that is the downstream passage F30.

Through-holes 45 are formed such that each through-hole 45 extends through the movable core 41, the coupling member 31 and the orifice member 32 in the radial direction. The through-holes 45 serve as a flow passage F28*s* that communicates between the flow passage F21, which is along the inner peripheral surface of the orifice member 32, and the flow passage F26*s*, which is along the outer peripheral surface of the movable core 41. The flow passage F28*s* is a passage that ensures a required flow rate of the fuel, which flows in the slide flow passage F27*s*, i.e., a required flow rate of the sub-passage in a case where the communication between the flow passage F24*s* and the flow passage F25*s* is blocked through contact of the coupling member 31 to the stopper 55. The flow passage F28*s* is placed on the upstream side of the restricting flow passage F22, so that the flow passages F25*s*, F26*s*, F28*s* form an upstream region, and a pressure difference is generated between the upstream region and a downstream region.

The fuel, which is outputted from the movable flow passage F20, flows into the flow passage F31, which is along the cylindrical outer peripheral surface of the coupling member 31, and then the fuel flows through a flow passage F32, which is a through-hole extending through the reduced diameter portion 24*a* of the support member 24 in the axial direction, and a flow passage F33, which is along the outer peripheral surface of the valve element 30 (see FIG. 2). When the valve element 30 makes the valve opening movement, the high pressure fuel in the flow passage F33 passes through the gap between the seat surface 30*s* and the seatable surface 23*s* and is injected from the injection hole 23*a*.

The flow passage, which is along the slide surface 33*a*, is referred to as the slide flow passage F27*s*. A passage cross-sectional area of the slide flow passage F27*s* is smaller than a passage cross-sectional area of the restricting flow passage F22. Specifically, a degree of flow restriction at the slide flow passage F27*s* is set to be larger than a degree of flow restriction at the restricting flow passage F22. The passage cross-sectional area of the restricting flow passage F22 is the smallest in the main passage, and the passage cross-sectional area of the slide flow passage F27*s* is the smallest in the sub-passage.

Therefore, among the main passage and the sub-passage in the movable flow passage F20, the fuel can more easily flow in the main passage. The degree of flow restriction of the main passage is specified by the degree of flow restriction at the orifice 32*a*, and the flow rate of the main passage is adjusted by the orifice 32*a*. In other words, the degree of flow restriction of the movable flow passage F20 is specified by the degree of flow restriction at the orifice 32*a*, and the flow rate of the movable flow passage F20 is adjusted by the orifice 32*a*.

A passage cross-sectional area of the flow passage F at the seat surface 30*s* in the full lift state, in which the valve element 30 has moved farthest in the valve opening direction, is referred to as a seat passage cross-sectional area. The passage cross-sectional area of the restricting flow passage F22 defined by the orifice 32*a* is set to be larger than the seat passage cross-sectional area. Specifically, the degree of flow restriction by the orifice 32*a* is set to be smaller than the degree of flow restriction at the seat surface 30*s* at the full lift time.

The seat passage cross-sectional area is set to be larger than the passage cross-sectional area of the injection hole 23*a*. Specifically, the degree of flow restriction by the orifice 32*a* and the degree of flow restriction at the seat surface 30*s* are set to be smaller than the degree of flow restriction at the injection hole 23*a*. In a case where a plurality of injection holes 23*a* is formed, the seat passage cross-sectional area is set to be larger than a sum of passage cross-sectional areas of all of the injection holes 23*a*.

Now, the movable member 35 will be described. When the fuel pressure on the upstream side of the movable member 35 becomes larger than the fuel pressure on the downstream side of the movable member 35 by a predetermined amount or larger in response to the movement of the valve element 30 in the valve opening direction, the movable member 35 is lifted away from the orifice member 32 against the resilient force of the resilient urging member SP2. When the fuel pressure on the downstream side of the movable member 35 becomes larger than the fuel pressure on the upstream side of the movable member 35 by a predetermined amount or larger in response to the movement of the valve element 30 in the valve closing direction, the movable member 35 is seated against the orifice member 32.

In the state where the movable member 35 is lifted away from the orifice member 32, a flow passage, which conducts the fuel, is generated between the outer peripheral surface of the movable member 35 and the inner peripheral surface of the coupling member 31. An outer-peripheral-side flow passage F23*a* and the sub-restricting passage 38 are arranged in parallel. In the state where the movable member 35 is lifted away from the orifice member 32, the fuel to be outputted from the restricting flow passage F22 to the flow passage F23, is branched into the sub-restricting passage 38 and the outer-peripheral-side flow passage F23*a*. A sum of the passage cross-sectional area of the sub-restricting passage 38 and the passage cross-sectional area of the outer-peripheral-side flow passage F23*a* is larger than the passage cross-sectional area of the restricting flow passage F22. Therefore, in the state where the movable member 35 is lifted away from the orifice member 32, the flow rate of the movable flow passage F20 is specified by the degree of flow restriction at the restricting flow passage F22.

In contrast, in the state where the movable member 35 is seated against the orifice member 32, the fuel to be outputted from the restricting flow passage F22 into the flow passage F23 flows in the sub-restricting passage 38 but does not flow in the outer-peripheral-side flow passage F23*a*. A passage cross-sectional area of the sub-restricting passage 38 is smaller than the passage cross-sectional area of the restricting flow passage F22. Therefore, in the state where the movable member 35 is seated against the orifice member 32, the flow rate of the movable flow passage F20 is specified by the degree of flow restriction at the sub-restricting passage 38. Thus, the movable member 35 increases the degree of flow restriction by covering the restricting flow passage F22 upon seating of the movable member 35 against the orifice member 32 and decreases the degree of flow restriction by opening the restricting flow passage F22 upon lifting of the movable member 35 from the orifice member 32.

In the state where the valve element 30 is in the middle of moving in the valve opening direction, there is a high probability of that the fuel pressure on the upstream side of the movable member 35 becomes larger than the fuel pressure on the downstream side of the movable member 35 by the predetermined amount or larger, and thereby the movable member 35 is lifted away from the orifice member 32. However, in a state where the valve element 30 is held in the full lift state, in which the valve element 30 has moved farthest in the valve opening direction, there is a high possibility that the movable member 35 is seated against the orifice member 32.

In the state where the valve element 30 is in the middle of moving in the valve closing direction, there is a high possibility that the fuel pressure on the downstream side of the movable member 35 becomes larger than the fuel pressure on the upstream side of the movable member 35 by the predetermined amount or larger, and thereby the movable member 35 is seated against the orifice member 32.

However, in a case where the valve opening period is shortened to reduce the injection amount of fuel injected from the injection hole 23*a*, the valve element 30 does not move to the full lift position, and thereby the valve opening movement is switched to the valve closing movement to execute a partial lift injection. In this case, immediately after switching from the valve opening movement to the valve closing movement, there is a high possibility that the movable member 35 is lifted away from the orifice member 32. However, in a time period immediately before the valve closing, there is a high possibility that the fuel pressure on the downstream side of the movable member 35 becomes larger that the fuel pressure on the upstream side of the movable member 35 by the predetermined amount or larger, and thereby the movable member 35 is seated against the orifice member 32.

In short, the movable member 35 is not necessarily always opened during the middle of the valve opening movement of the valve element 30, and the movable member 35 is seated against the orifice member 32 in at least the time period immediately after the valve opening in the pressure increasing period, in which the valve element 30 is moved in the valve opening direction. Furthermore, the movable member 35 is not necessarily always seated against the orifice member 32 during the middle of the valve closing movement of the valve element 30, and the movable member 35 is seated against the orifice member 32 in at least the time period immediately before the valve closing in the pressure decreasing period, in which the valve element 30 is moved in the valve closing direction. Therefore, in the time period immediately after the valve opening and the time period immediately before the valve closing, the movable member 35 is seated against the orifice member 32, and thereby all of the fuel passes through sub-restricting passage 38. Thus, in comparison to the time period, in which the movable member 35 is lifted away from the orifice member 32, the degree of flow restriction at the movable flow passage F20 is increased.

Figure 4:
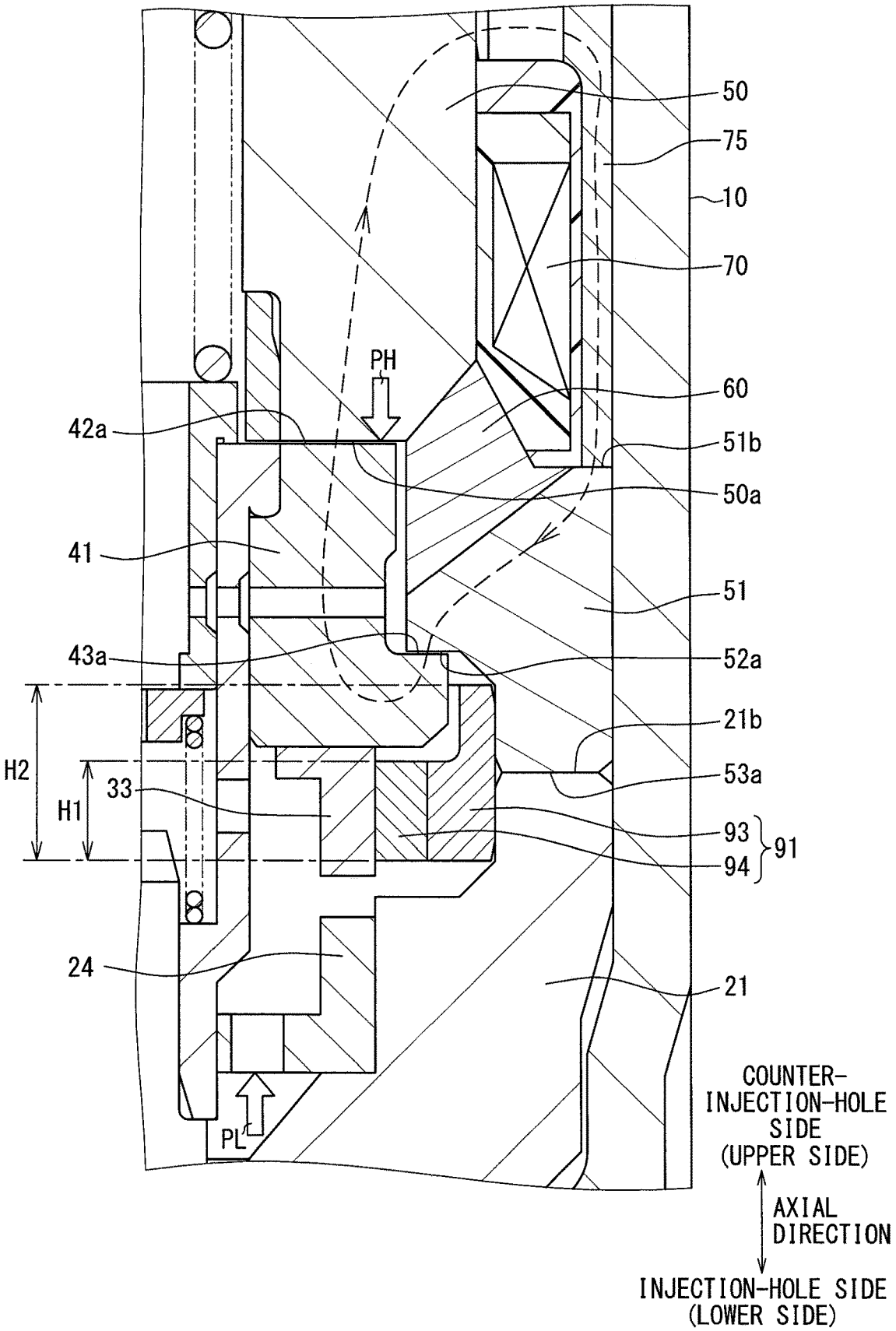
FIG. 4 is a diagram for describing a passage of a magnetic flux.
Figure 5:
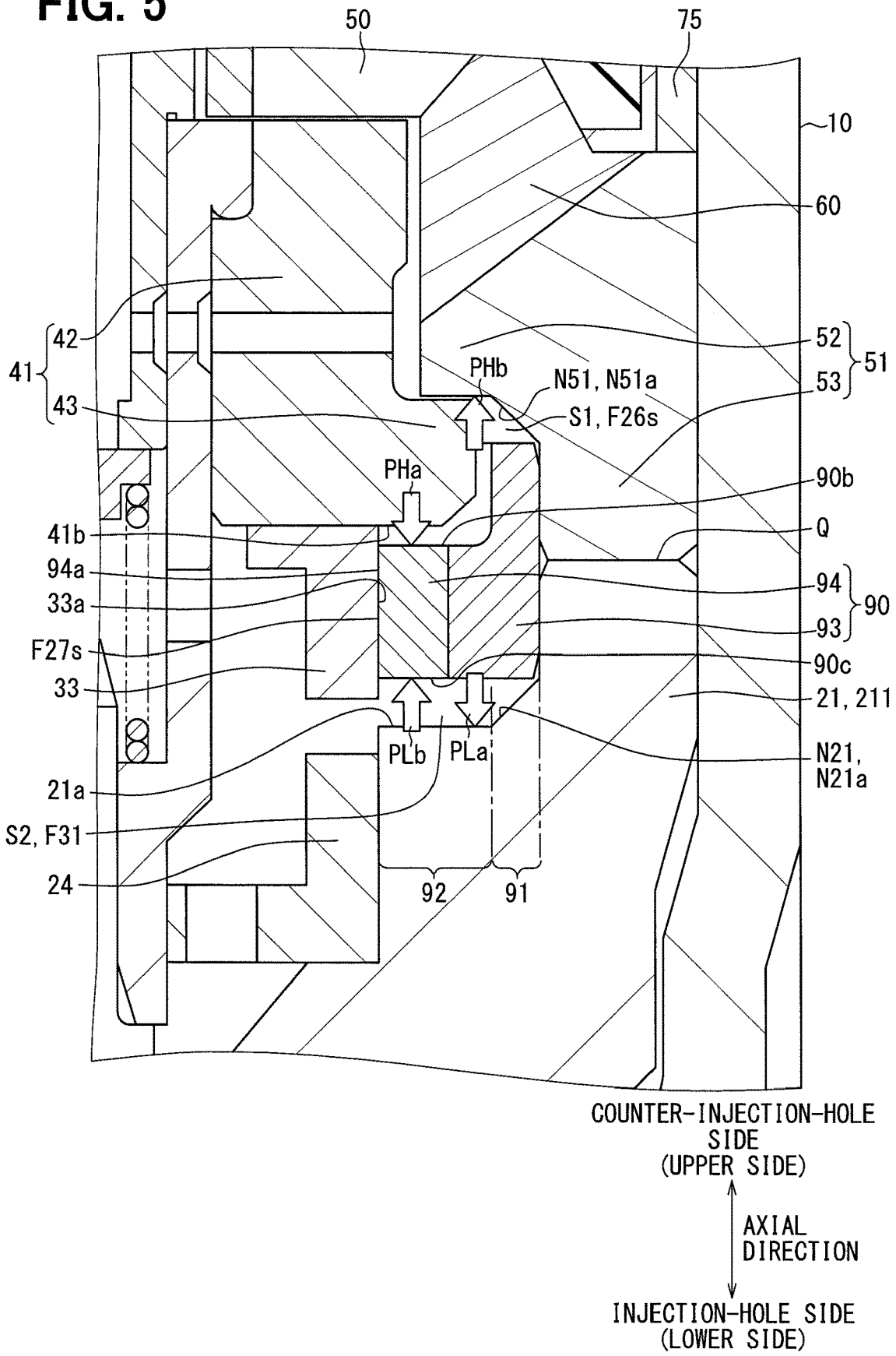
FIG. 5 is a diagram for describing a relationship between the cover body and a fuel pressure.

Next, pressures, which are generated at the time of moving the movable structure M, will be described with reference to FIGS. 4 to 6.

In the present embodiment, the restricting flow passage F22 and the slide flow passage F27*s* are arranged in parallel, and the passage cross-sectional area of the slide flow passage F27*s* is set to be smaller than the passage cross-sectional area of the restricting flow passage F22. Therefore, the flow passage F is divided into the upstream region and the downstream region while the orifice 32*a* and the slide flow passage F27*s* form a boundary between the upstream region and the downstream region.

The upstream region is a region, which is located on the upstream side of the orifice 32*a* in the fuel flow at the fuel injection time. A portion of the movable flow passage F20, which is located on the upstream side of the slide surface 33*a*, also belongs to the upstream region. Therefore, the flow passages F21, F24*s*, F25*s*, F26*s*, F28*s* and the upstream flow passage F10 in the movable flow passage F20 belong to the upstream region. The downstream region is a region, which is located on the downstream side of the orifice 32*a* in the fuel flow at the fuel injection time. A portion of the movable flow passage F20, which is located on the downstream side of the slide surface 33*a*, also belongs to the downstream region. Therefore, the flow passage F23 and the downstream flow passage F30 in the movable flow passage F20 belong to the downstream region.

Specifically, when the fuel flows in the restricting flow passage F22, the flow rate of the fuel, which flows in the movable flow passage F20, is restricted by the orifice 32*a*. Therefore, a pressure difference is generated between an upstream fuel pressure PH, which is a fuel pressure of the upstream region, and a downstream fuel pressure PL, which is a fuel pressure of the downstream region (see FIG. 4). At the time of shifting the valve element 30 from the valve closing state to the valve opening state, the time of shifting the valve element 30 from the valve opening state to the valve closing state, and the time of holding the valve element 30 at the full lift position, the fuel flows in the restricting flow passage F22, and thereby the above-described pressure difference is generated.

The above-described pressure difference, which is generated by the valve opening operation of the valve element 30, is not lost simultaneously with the switching from the valve opening to the valve closing. Rather, the upstream fuel pressure PH and the downstream fuel pressure PL become equal to each other when a predetermined time period elapses from the time of valve closing. In contrast, when the operation is switched from the valve closing to the valve opening in the state where the above-described pressure difference is not generated, the above-described pressure difference is immediately generated at the timing of switching from the valve closing to the valve opening.

During the movement of the movable structure M in the valve opening direction, the fuel of the upstream region is urged and is compressed by the movable structure M, so that the upstream fuel pressure PH is increased. In contrast, the fuel of the upstream region, which is urged by the movable structure M, is restricted by the orifice 32*a* and is pushed into the downstream region, so that the downstream fuel pressure PL becomes lower than the upstream fuel pressure PH. At the time of the valve opening movement, the fuel flows in the restricting flow passage F22 toward the injection-hole side.

During the movement of the movable structure M in the valve closing direction, the fuel of the downstream region is urged and is compressed by the movable structure M, so that the downstream fuel pressure PL is increased. In contrast, the fuel of the downstream region, which is urged by the movable structure M, is restricted by the orifice 32*a* and is pushed into the upstream region, so that the upstream fuel pressure PH becomes lower than the downstream fuel pressure PL. At the time of valve closing movement, the fuel flows in the restricting flow passage F22 toward the counter-injection-hole side.

Now, a relationship between the cover body 90 and the fuel pressure will be described with reference to FIG. 5. At the cover upper chamber S1, which is located on the counter-injection-hole side of the cover body 90, the upper chamber downward fuel pressure PHa and the upper chamber upward fuel pressure PHb, which correspond to the upstream fuel pressure PH, are generated due to the fact that the cover upper chamber S1 is included in the upstream region. The upper chamber downward fuel pressure PHa is a pressure, which urges the cover body 90 toward the injection-hole side, and the upper chamber downward fuel pressure PHa is applied to both of the cover outside 91 and the cover inside 92. For example, the cover upper surface 90*b* is downwardly urged. In contrast, the upper chamber upward fuel pressure PHb is a pressure, which urges the second stationary core 51 toward the counter-injection-hole side, and the upper chamber upward fuel pressure PHb is applied to the second inside 52. For example, the second inside lower surface 52*a* is upwardly urged.

At the cover lower chamber S2, which is located on the injection-hole side of the cover body 90, since the cover lower chamber S2 is included in the downstream region, a lower chamber downward fuel pressure PLa and a lower chamber upward fuel pressure PLb, which correspond to the downstream fuel pressure PL, are generated. The lower chamber upward fuel pressure PLb is a pressure, which upwardly urges the cover body 90 toward the counter-injection-hole side, and the lower chamber upward fuel pressure PLb is applied to both of the cover outside 91 and the cover inside 92 in the cover lower chamber S2. For example, the cover lower surface 90*c* is upwardly urged. In contrast, the lower chamber downward fuel pressure PLa is a pressure that downwardly urges the body main portion 21 toward the injection-hole side. For example, the main portion inside upper surface 21*a* is downwardly urged.

As discussed above, in the state where the fuel pressures PHa, PHb are generated on the counter-injection-hole side of the cover body 90, and the fuel pressures PLa, PLb are generated on the injection-hole side of the cover body 90, the upper chamber downward fuel pressure PHa and the lower chamber upward fuel pressure PLb counteract with each other through the cover body 90. Similarly, the upper chamber upward fuel pressure PHb and the lower chamber downward fuel pressure PLa counteract with each other through the second stationary core 51 and the body main portion 21. Therefore, there is limited application of the pressures in the directions for moving the second stationary core 51 and the body main portion 21 away from each other in the up-to-down direction in the cover upper chamber S1 and the cover lower chamber S2.

Figure 6:
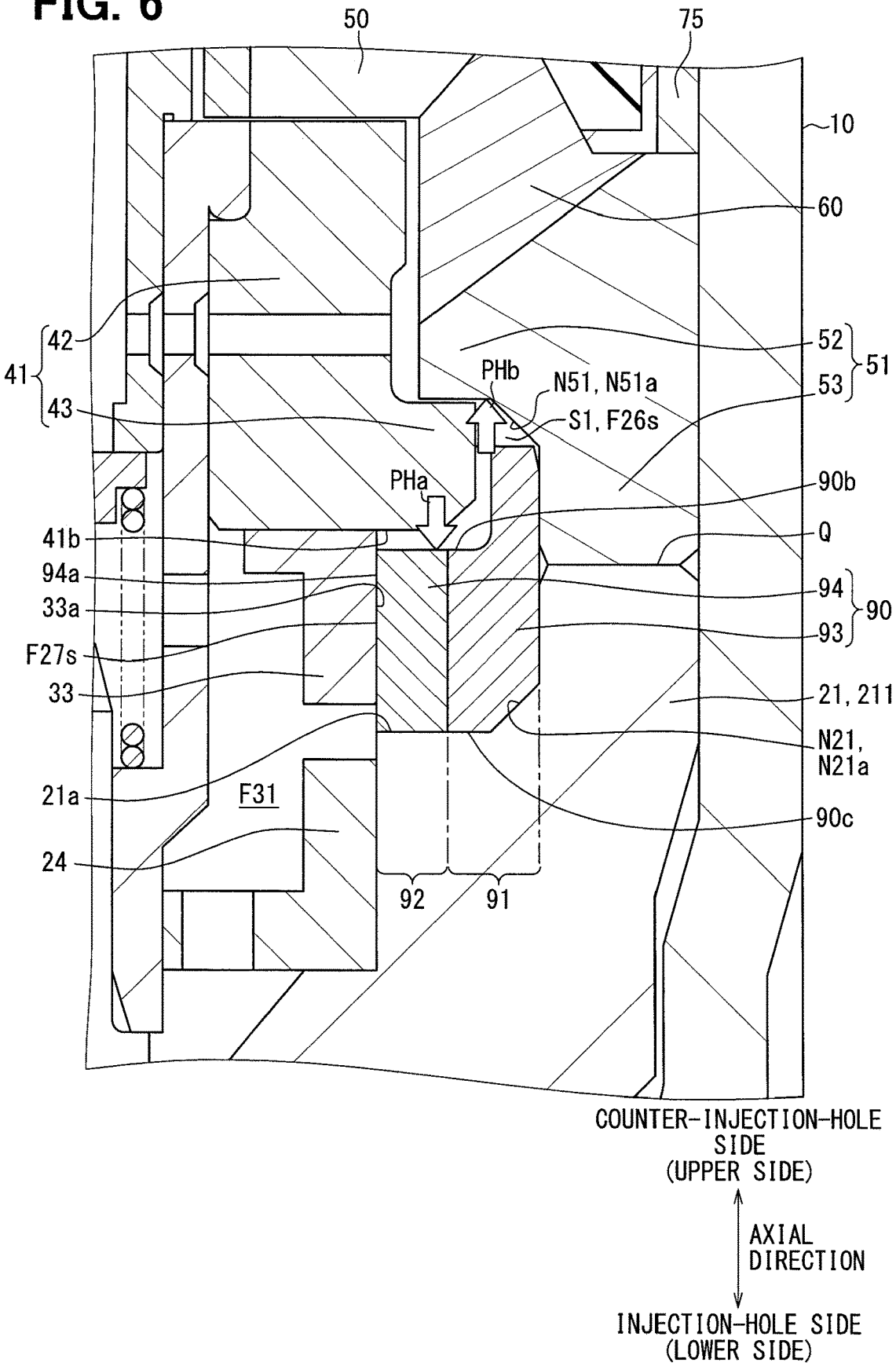
FIG. 6 is a diagram indicating a comparative configuration, in which a cover lower chamber is absent.

For example, in a structure, in which the cover upper chamber S1 is formed while the cover lower chamber S2 is not formed as shown in FIG. 6, the pressure, which counteracts against the upper chamber downward fuel pressure PHa, is not applied to the cover body 90, and the pressure, which counteracts against the upper chamber upward fuel pressure PHb, is not applied to the body main portion 21. Therefore, the upper chamber downward fuel pressure PHa downwardly urges the body main portion 21 together with the cover body 90 toward the injection-hole side, and the upper chamber upward fuel pressure PHb upwardly urges the second stationary core 51 toward the counter-injection-hole side. In this case, the fuel pressures PHa, PHb are exerted to move the second stationary core 51 and the body main portion 21 away from each other. Therefore, this is not preferable in view of properly maintaining the joint state between the second stationary core 51 and the body main portion 21 at the stationary boundary Q. In contrast, according to the present embodiment, as discussed above, the fuel pressures PHa, PHb in the cover upper chamber S1 and the fuel pressures PLa, PLb in the cover lower chamber S2 counteract with each other, so that this is preferable in view of properly maintaining the joint state between the second stationary core 51 and the body main portion 21 at the stationary boundary Q.

Next, the function of the cover upper chamber S1 will be described. As discussed above, in the middle of moving the movable structure M in the valve closing direction, the fuel flows from the flow passage F31 (e.g., the cover lower chamber S2) to the cover upper chamber S1 through the restricting flow passage F22. In this case, at the flow passage F26*s*, due to the presence of the flow passages F24*s*, F25*s* on the upstream side of the cover upper chamber S1, it is difficult for the fuel to flow from the cover upper chamber S1 to the main passage (e.g., the flow passage F21) and the upstream flow passage F10 (e.g., the flow passage F13). In other words, in order to create the flow of the fuel out of the cover upper chamber S1 toward the main passage and the upstream flow passage F10, the movable lower surface 41*b* of the movable core 41 needs to be moved toward the cover upper surface 90*b* of the cover body 90 in the axial direction against the valve closing force of the resilient member SP1. At the time of moving the movable structure M in the valve closing direction, the cover upper chamber S1 implements a damper function and thereby exerts a brake force against the movable structure M. Therefore, the bouncing of the valve element 30 at the seatable surface 23*s* is limited at the valve closing time, and thereby an unintended fuel injection is limited.

Hereinafter, a manufacturing method of the fuel injection valve 1 will be described with reference to FIG. 7. Here, an assembling procedure after manufacturing the respective components will be mainly described.

Figure 7:
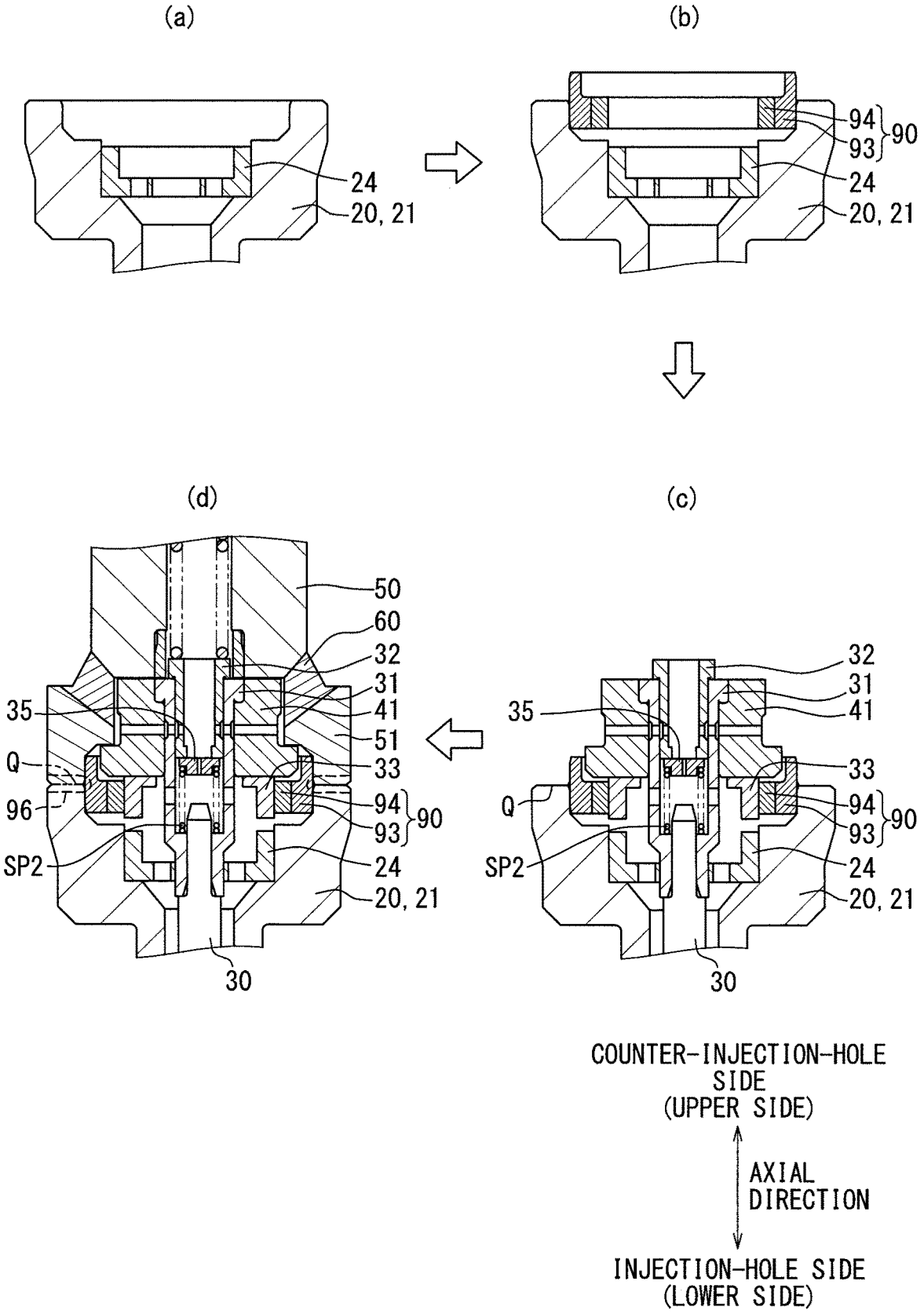
FIG. 7 is a diagram indicating: (a) installation of a support member to a body main portion; (b) installation of the cover body to the body main portion; (c) installation of a movable structure to a nozzle body; and (d) installation of a stationary core to a nozzle body.

As indicated at (a) of FIG. 7, first of all, the support member 24 is installed to the body main portion 21 of the nozzle body 20. Here, the support member 24 is inserted into the inside of the body main portion 21, and the body main portion 21 and the support member 24 are fixed together by, for example, welding.

Next, as indicated at (b) of FIG. 7, the cover body 90 is installed to the body main portion 21. Here, the opposing member 94 is inserted into the inside of the cover member 93, and the cover member 93 and the opposing member 94 are fixed together by, for example, welding. Thereby, the cover body 90 is produced in advance. Then, the cover body 90 is inserted into the inside of the body main portion 21. In this case, a length of the inserted portion of the cover body 90, which is inserted into the inside of the body main portion 21, and a length of the projecting portion of the cover body 90, which projects from the body main portion 21, are set to be substantially equal to each other. The length of the inserted portion of the cover body 90 corresponds to the separation distance H2*b*, and the length of the projecting portion of the cover body 90 corresponds to the separation distance H2*a*.

Thereafter, as indicated at (c) of FIG. 7, the movable structure M is installed to the nozzle body 20. The movable structure M is manufactured in advance by assembling the movable core 41, the coupling member 31, the valve element 30, the orifice member 32, the slide member 33, the movable member 35 and the resilient urging member SP2 together. Here, the movable structure M is installed to the nozzle body 20 by inserting the valve element 30 into the inside of the nozzle portion 22 and inserting the slide member 33 into the inside of the cover body 90.

Next, as indicated at (d) of FIG. 7, the stationary cores 50, 51 and the non-magnetic member 60 are installed to the nozzle body 20. Here, a core unit is manufactured in advance by installing the stationary cores 50, 51 to the non-magnetic member 60 and fixing the non-magnetic member 60 and the stationary cores 50, 51 together by, for example, welding. Then, the second stationary core 51 is installed to the body main portion 21 and the cover body 90 by installing the core unit to the nozzle body 20. In this case, the end portion of the cover body 90 is inserted into the inside of the second stationary core 51, and the second lower surface 51*a* of the second stationary core 51 is overlapped with the main portion outside upper surface 21*b* of the body main portion 21. In this way, the stationary boundary Q is present between the second stationary core 51 and the body main portion 21.

Thereafter, a welding operation is performed all around the stationary boundary Q from the radially outer side of the stationary boundary Q through use of a welding tool, so that the welding portion 96 is formed. In this case, spatter particles, such as slag, metal particles or the like, which are generated at the time of welding, may possibly be scattered into the inside space of the second stationary core 51 and the body main portion 21 through the stationary boundary Q. With respect to this point, the cover body 90 covers the stationary boundary Q from the radially inner side, so that even if the spatter particles are generated by the welding, the spatter particles collide against the cover body 90 and will not fly further toward the radially inner side. Therefore, scattering of the spatter particles beyond the stationary boundary Q toward the radially inner side is limited by the cover body 90.

The welding is performed such that the welding portion 96 reaches the cover body 90 beyond the stationary boundary Q. Here, a test is conducted to know a required heating temperature and a required heating time period, which are required to extend the welding portion 96 to the cover body 90 beyond the stationary boundary Q at the time of applying the heat for the welding. Then, a heating temperature and a heating time period at the time of welding are set based on this test result. In this way, it is possible to limit occurrence of a state where the welding portion 96 does not reach the cover body 90.

Once the welding portion 96 is formed, the coil 70 and the yoke 75 are installed to the first stationary core 50. Then, these components are received into the case 10, so that the manufacturing of the fuel injection valve 1 is completed.

Next, effects and advantages of the structure used in the present embodiment will be described.

According to the present embodiment, the stationary boundary Q is covered by the cover body 90 from the radially inner side. Therefore, at the time of manufacturing the fuel injection valve 1, it is possible to limit flying of spatter particles, which are generated by the welding applied from the radially outer side, into the inside space of the second stationary core 51 and the body main portion 21 through the stationary boundary Q. In this case, it is possible to limit occurrence of malfunctioning of the fuel injection through the injection hole 23*a* caused by the presence of the spatter particles at the flow passages F26*s*, F31. Thereby, it is possible to implement the structure that enables the appropriate injection of the fuel even when the second stationary core 51 and the body main portion 21 are joined together by the welding.

According to the present embodiment, the cover member 93 and the body main portion 21 are both made of the non-magnetic material. Therefore, the cover member 93 and the body main portion 21 will less likely become the passage of the magnetic flux. Thus, in the case where the magnetic flux is generated through the energization of the coil 70, the amount of the magnetic flux, which passes through the second inside lower surface 52*a* and the movable outside upper surface 43*a*, is reduced, and thereby it is possible to limit a reduction in the attractive force between the second stationary core 51 and the movable core 41. If the cover member 93 and the body main portion 21 become the passage of the magnetic flux, the amount of the magnetic flux, which flows from the movable core 41 and reaches the second stationary core 51 through the cover member 93 and the body main portion 21, is increased.

Furthermore, since the cover member 93 is placed between the opposing member 94 and the second stationary core 51, the opposing member 94 and the second stationary core 51 are spaced from each other. Therefore, even when the degree of magnetism of the opposing member 94 is higher than the degree of magnetism of the cover member 93, it is possible to limit the flow of the magnetic flux from the movable core 41 to the second stationary core 51 through the opposing member 94.

According to the present embodiment, since the cover member 93 is a member that is formed separately from the second stationary core 51 and the body main portion 21, the shape, the size and the degree of the magnetism of the cover member 93 can be set independently from the second stationary core 51 and the body main portion 21. Therefore, the design freedom of the cover member 93 can be increased. Furthermore, in comparison to a structure where the cover member 93 is made of a portion of the second stationary core 51 or a portion of the body main portion 21, it is possible to limit a complication in the shape of the second stationary core 51 and the shape of the body main portion 21.

According to the present embodiment, the welding portion 96 includes the portion of the cover member 93 in addition to the portion of the second stationary core 51 and the portion of the body main portion 21. Therefore, the three members, i.e., the second stationary core 51, the body main portion 21 and the cover member 93 can be joined together by executing the welding operation. Thus, the work load at the time of manufacturing the fuel injection valve 1 can be reduced. Furthermore, it is possible to limit unintentional deviation of the position of the cover member 93 at the inside space of the second stationary core 51 and the inside space of the body main portion 21, and thereby it is possible to limit inappropriate injection of the fuel from the injection hole 23*a*.

According to the present embodiment, since the upper surface and the lower surface of the cover member 93 respectively form the flow passages, the fuel pressures, which are respectively generated at these flow passages, can counteract with each other. Therefore, it is possible to limit generation of the fuel pressure in a direction for urging the second stationary core 51 and the body main portion 21 away from each other. Specifically, the cover upper surface 90*b* forms the cover upper chamber S1 at the flow passage F26*s*, and the cover lower surface 90*c* forms the cover lower chamber S2 at the flow passage F31. In this case, since the fuel pressures PHa, PHb, which are generated at the cover upper chamber S1, counteract against the fuel pressures PLa, PLb, which are generated at the cover lower chamber S2, the joined state, in which the second stationary core 51 and the body main portion 21 are joined together by the welding portion 96, can be appropriately maintained.

In the present embodiment, the cover body 90 includes the opposing member 94 in addition to the cover member 93. Therefore, at the time of manufacturing the fuel injection valve 1, the cover body 90 has a spatter limiting function for limiting the intrusion of the spatter particles. Furthermore, after the completion of the manufacturing of the fuel injection valve 1, the cover body 90 has a guiding function for guiding the movement of the movable structure M. Furthermore, since the slide member 33 of the movable structure M is configured to slide relative to the opposing member 94, the degree of flow restriction of the slide flow passage F27*s*, which is a gap between the opposing member 94 and the slide member 33, can be increased. As described above, the cover body 90 has the various functions, such as the spatter intrusion limiting function, the guiding function and the flow restricting function, as described above. Therefore, it is possible to limit the complication in the structure of the fuel injection valve 1 in comparison to a structure, in which these functions are implemented by different members, respectively.

According to the present embodiment, the cover upper chamber S1 is located on the upstream side of the slide flow passage F27*s* in the sub-passage. Therefore, a damper function can be implemented at the cover upper chamber S1 when the movable structure M is moved in the valve closing direction. In other words, by using the structure, in which the fuel cannot be easily outputted from the cover upper chamber S1 to the upstream side, a brake force can be applied to the movable structure M, which is moved in the valve closing direction. In this way, it is possible to limit the bouncing of the valve element 30 at the seatable surface 23*s* at the valve closing time. Thereby, the unintended fuel injection can be limited.

According to the present embodiment, the cover member 93 and the body main portion 21 are made of the non-magnetic material. Therefore, even if the degree of magnetism of the opposing member 94 is relatively high, the opposing member 94 will less likely become the passage of the magnetic flux. Therefore, at the designing stage, the material of the opposing member 94 can be selected such that a high priority is given to the hardness and the strength rather than the low degree of magnetism. In this case, even when the slide member 33 is slid, wearing and deformation are less likely to occur at the opposing member 94. Therefore, it is possible to limit a change in the passage cross-sectional area of the slide flow passage F27*s* caused by the wearing and the deformation of the opposing member 94. Thereby, it is possible to limit a change in the amount of fuel injected from the injection hole 23*a* caused by the wearing and the deformation of the opposing member 94.

According to the present embodiment, the movable core 41 has the movable inside upper surface 42*a* and the movable outside upper surface 43*a* as the two attractive surfaces, through which the magnetic flux flows. Therefore, in comparison to a structure, in which the movable core 41 has only a single attractive surface, it is possible to increase the attractive force between the movable core 41 and the stationary cores 50, 51. In this structure, since the non-magnetic member 60 is placed between the first stationary core 50 and the second stationary core 51, it is possible to limit short circuiting of the magnetic flux between the first stationary core 50 and the second stationary core 51.

Here, it is conceivable to implement the function of the second stationary core 51 at a portion of the body main portion 21 instead of forming the second stationary core 51 by the dedicated member that is dedicated to form the second stationary core 51. However, in this method, it is required to select the material of the body main portion 21 from the limited number of materials that have the required hardness and the required strength for receiving the portion of the movable structure M and has the high degree of magnetism. In this case, the material costs and the manufacturing costs of the body main portion 21 may possibly be increased. In contrast, in the case where the second stationary core 51 and the body main portion 21 are designed to be made by different members, respectively, the second stationary core 51 can be made from the material, which has the high degree of magnetism, and the body main portion 21 can be made from the material, which has the high hardness and the high strength. In this way, it is possible to limit an increase in the manufacturing costs of the second stationary core 51 and the body main portion 21.

Furthermore, at the time of manufacturing the fuel injection valve 1, the scattering of the spatter particles into the stationary boundary Q at the time of welding between the second stationary core 51 and the body main portion 21 can be limited by covering the stationary boundary Q with the cover body 90 from the inside of the stationary boundary Q.

Second Embodiment

In the first embodiment, the cover member 93, which serves as a covering portion, and the opposing member 94, which serves as the guiding portion, are formed as separate members that are formed separately from the body main portion 21. In the second embodiment, the cover portion and the guiding portion are formed by a portion of the body main portion 21.

Figure 8:
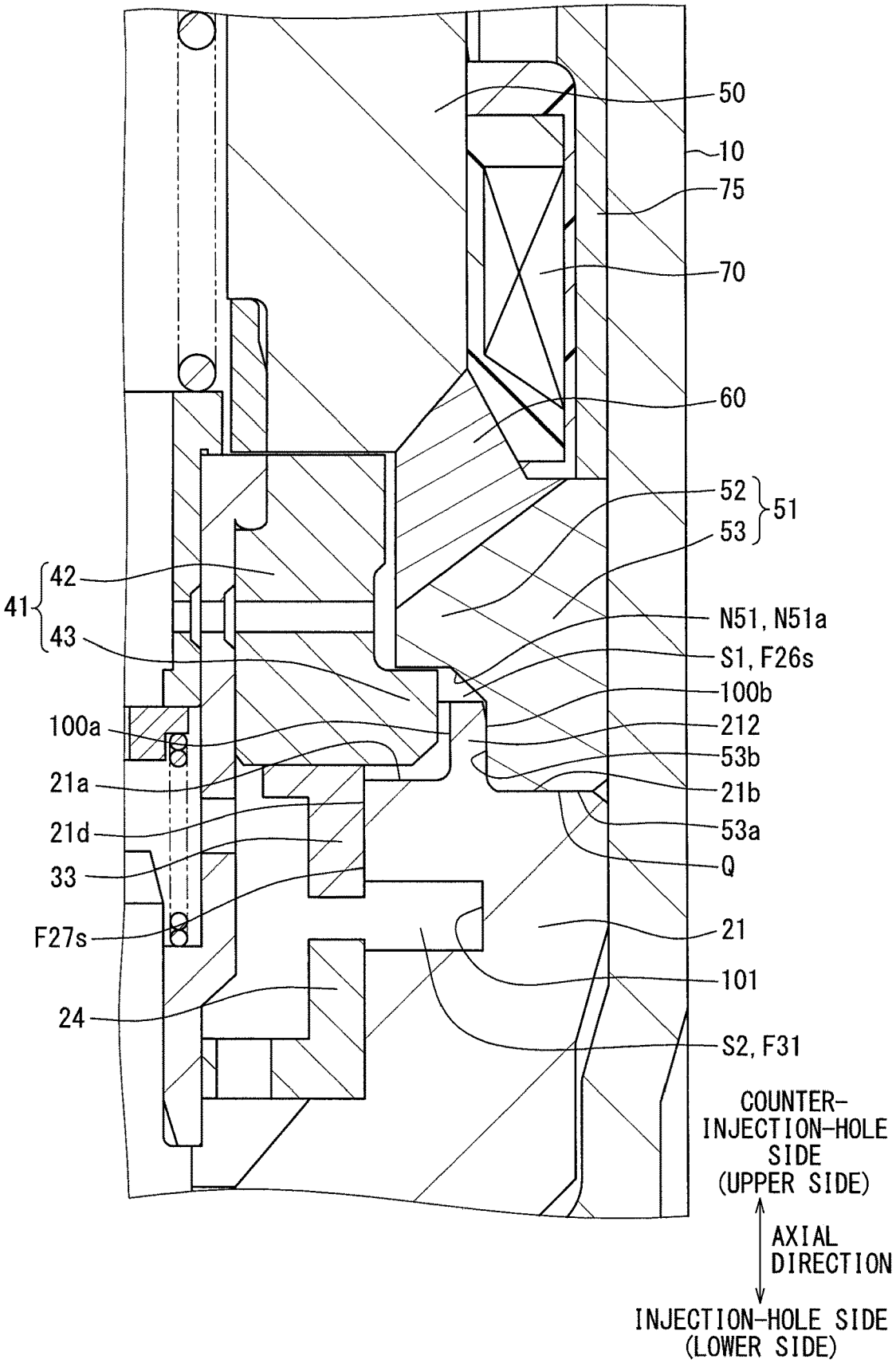
FIG. 8 is a cross-sectional view of a fuel injection valve according to a second embodiment and is also an enlarged view showing an area around a movable core of the second embodiment.
Figure 9:
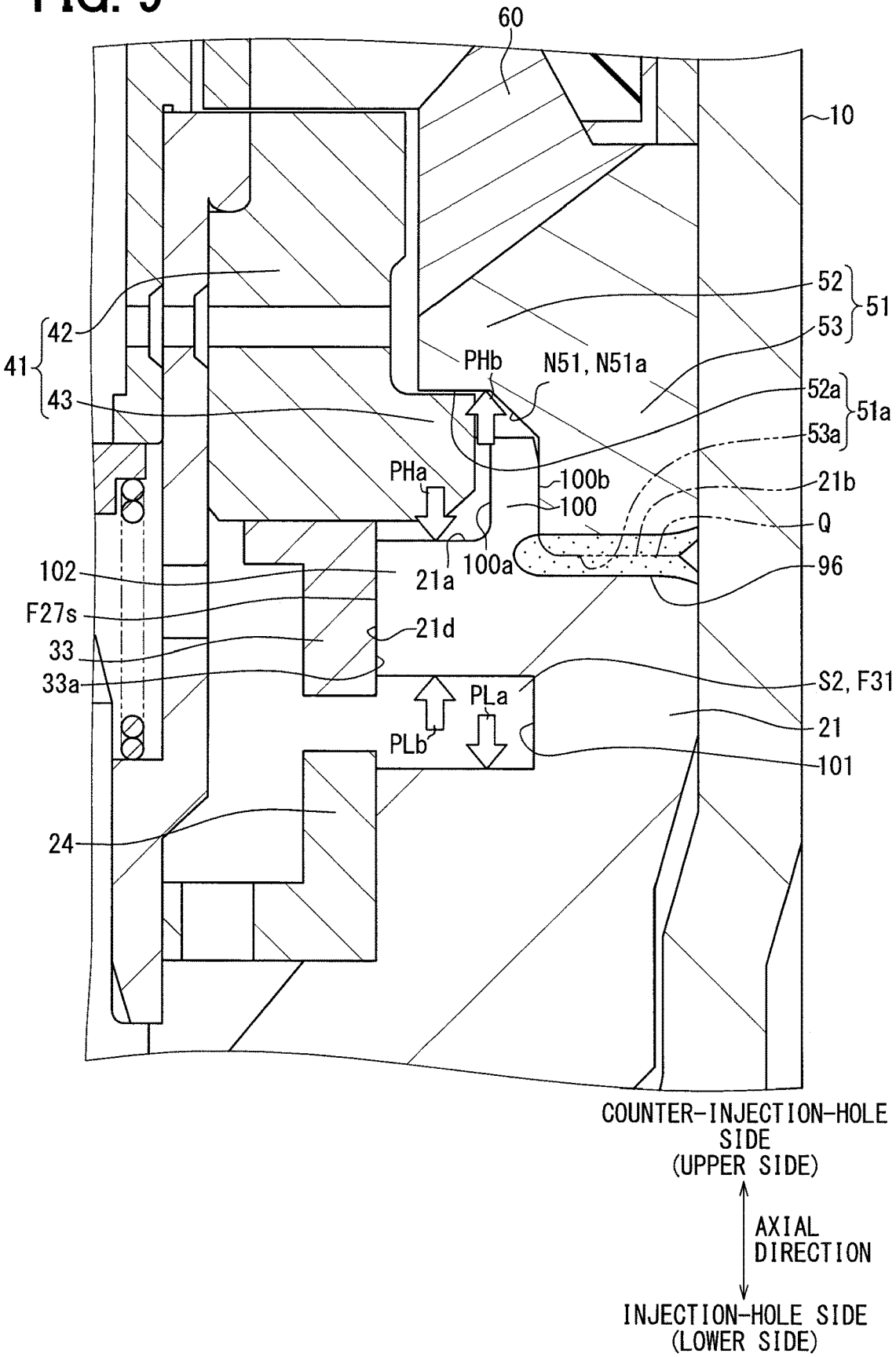
FIG. 9 is a diagram for describing a fuel pressure and a welding portion.

As shown in FIGS. 8 and 9, the body main portion 21 includes an intermediate projecting portion 100 instead of the outside projection 211. The intermediate projecting portion 100 is an annular portion that projects from a radial intermediate location of the upper end surface of the body main portion 21 toward the counter-injection-hole side. The intermediate projecting portion 100 is spaced from both of the radially inner end portion and the radially outer end portion of the upper end surface of the body main portion 21. The intermediate projecting portion 100 has an intermediate inner surface 100*a* and an intermediate outer surface 100*b*. The intermediate inner surface 100*a* faces the radially inner side, and the intermediate outer surface 100*b* faces the radially outer side. The intermediate projecting portion 100 is placed between the main portion inside upper surface 21*a* and the main portion outside upper surface 21*b* in the radial direction at the upper end surface of the body main portion 21. In the present embodiment, unlike the first embodiment, the main portion inside upper surface 21*a* is placed on the counter-injection-hole side of the main portion outside upper surface 21*b*.

Even in the present embodiment, similar to the first embodiment, the main portion outside upper surface 21*b* and the second outside lower surface 53*a* are included in the stationary boundary Q. In contrast, the intermediate projecting portion 100 is placed at a location where the intermediate outer surface 100*b* overlaps with the second outside inner surface 53*b* of the second stationary core 51 in the radial direction. In this case, in the present embodiment, a base end portion of the intermediate projecting portion 100, which is an end portion of the intermediate projecting portion 100 on the injection-hole side, covers the stationary boundary Q from the radially inner side, and thereby the intermediate projecting portion 100 serves as a covering portion. Therefore, similar to the first embodiment, even when the welding operation at the stationary boundary Q is performed at the time of manufacturing the fuel injection valve 1, the intrusion of the spatter particles toward the flow passages F26*s*, F31 through the stationary boundary Q is limited by the intermediate projecting portion 100. Here, the intermediate projecting portion 100 is placed in a state where the intermediate projecting portion 100 is inserted into the inside of the second cutout N51 from the injection-hole side.

Similar to the first embodiment, the welding portion 96 extends to a location that is on the radially inner side of the stationary boundary Q. Therefore, a portion of the intermediate projecting portion 100, which is located around the base end of the intermediate projecting portion 100, is included in the welding portion 96.

The body main portion 21 includes a main portion recess 101 that is radially outwardly recessed from the main portion inside inner surface 21*d*. The main portion recess 101 is placed at an intermediate location of the main portion inside inner surface 21*d* in the axial direction. The main portion recess 101 is shaped in an annular form and extends along an entire circumferential extent of the body main portion 21. An inside space of the main portion recess 101 forms the cover lower chamber S2 and is communicated with the gap between the slide member 33 and the support member 24. A depth of the main portion recess 101, which is measured in the radial direction, is substantially the same as the separation distance, which is measured in the radial direction between the intermediate outer surface 100*b* and the main portion inside inner surface 21*d*.

A portion of the body main portion 21, which is located on the counter-injection-hole side of the main portion recess 101, is opposed to the slide member 33 and is referred to as an opposing portion 102. Similar to the opposing member 94 of the first embodiment, the opposing portion 102 implements the function of the guide portion, which guides the moving direction of the movable structure M upon sliding the slide member 33 along the opposing portion 102. In this case, a portion of the main portion inside inner surface 21*d*, which is located on the counter-injection-hole side of the main portion recess 101, serves as an opposing surface of the opposing portion 102, which is opposed to the slide surface 33*a*.

Even in the present embodiment, the cover upper chamber S1 and the cover lower chamber S2 are placed on the upper side and the lower side of the intermediate projecting portion 100 and the opposing portion 102. Therefore, similar to the first embodiment, as shown in FIG. 9, the upper chamber downward fuel pressure PHa counteracts against the lower chamber upward fuel pressure PLb, and the upper chamber upward fuel pressure PHb counteracts against the lower chamber downward fuel pressure PLa.

Third Embodiment

Figure 10:
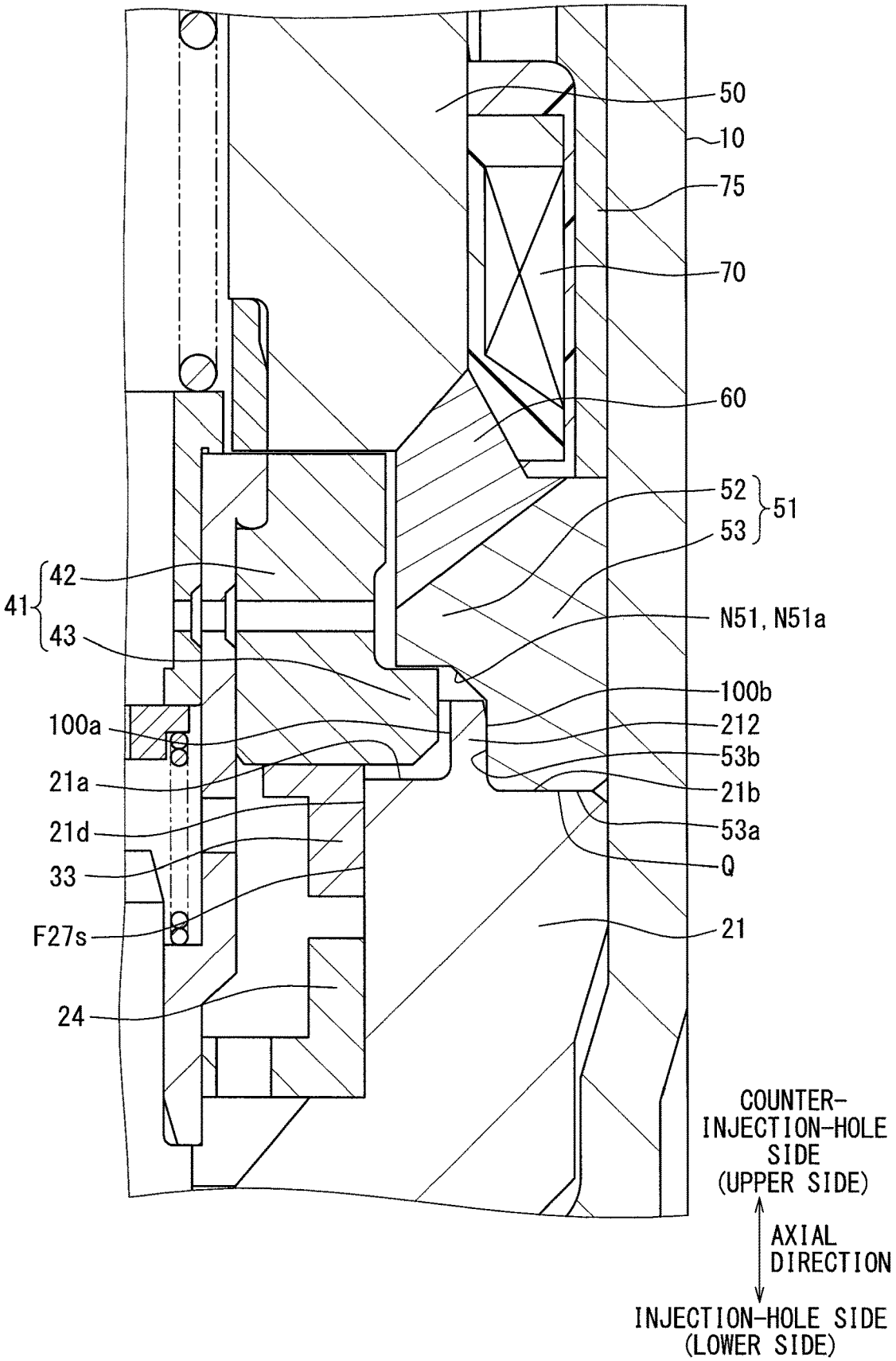
FIG. 10 is a cross-sectional view of a fuel injection valve according to a third embodiment and is also an enlarged view showing an area around a movable core of the third embodiment.

In the second embodiment, the main portion recess 101 is formed at the body main portion 21. In the third embodiment, as shown in FIG. 10, the main portion recess 101 is not formed at the body main portion 21. In this structure, the cover upper chamber S1 is formed on the counter-injection-hole side of the intermediate projecting portion 100 and the opposing portion 102. However, unlike the second embodiment, the cover lower chamber S2 is not formed on the injection-hole side of the intermediate projecting portion 100 and the opposing portion 102. Therefore, the lower chamber downward fuel pressure PLa and the lower chamber upward fuel pressure PLb are not generated. Therefore, the upper chamber downward fuel pressure PHa and the upper chamber upward fuel pressure PHb may possibly be exerted to urge the body main portion 21 and the second stationary core 51 away from each other in the axial direction. However, similar to the second embodiment, even when the welding operation at the stationary boundary Q is performed at the time of manufacturing the fuel injection valve 1, the intrusion of the spatter particles toward the flow passages F26*s*, F31 through the stationary boundary Q is limited by the intermediate projecting portion 100. Therefore, the body main portion 21 and the second stationary core 51 are strongly welded together, and thereby the separation of the body main portion 21 and the second stationary core 51 away from each other in the axial direction is limited.

In the present embodiment, a portion of the body main portion 21, which is opposed to the slide member 33, corresponds to the opposing portion, and this opposing portion may be referred to as a guiding portion that guides the movement of the movable structure M. Furthermore, a portion of the inner peripheral surface of the body main portion 21, which is opposed to the slide surface 33*a* of the slide member 33, may be referred to as an opposing portion, and this opposing portion may be also referred to as a guiding portion.

Other Embodiments

The embodiments of the present disclosure have been described. However, the present disclosure should not be limited to the above embodiments and can be applied to various embodiments and combinations of the embodiments without departing from the scope of the present disclosure.

In a first modification, the movable core 41 of each of the above embodiments may be configured such that instead of placing the movable outside upper surface 43*a* on the injection-hole side of the movable inside upper surface 42*a*, the movable outside upper surface 43*a* may be placed on the counter-injection-hole side of the movable inside upper surface 42*a*. Furthermore, the movable outside upper surface 43*a* and the movable inside upper surface 42*a* may be placed at the same location in the axial direction. Specifically, the movable outside upper surface 43*a* and the movable inside upper surface 42*a* may be placed adjacent to each other in the radial direction.

In a second modification, the movable core 41 of each of the above embodiments may have a single attractive surface instead of the two attractive surfaces. For example, the movable core 41 may not have the movable outside upper surface 43*a*. In this structure, the first stationary core 50 is placed after the movable core 41 in the axial direction, and the second stationary core 51 is placed after the movable core 41 in the radial direction. In this case, the second stationary core 51 does not have the attractive surface that is attracted to the movable core 41 in the axial direction. However, the second stationary core 51 forms the passage of the magnetic flux like in the above embodiments.

In each of the above embodiments, the cover upper chamber S1 is formed. Alternatively, in a third modification, the cover upper chamber S1 may be eliminated like in the third embodiment where the cover lower chamber S2 is eliminated. For example, in the first embodiment, the cover upper surface 90*b* of the cover body 90 and the second lower surface 51*a* of the second stationary core 51 may be overlapped with each other, and the cover lower surface 90*c* of the cover body 90 and the upper end surface of the body main portion 21 may be overlapped with each other.

In the first embodiment, the main portion cutout N21 and the second cutout N51, which receive the cover body 90, are formed at the body main portion 21 and the second stationary core 51, respectively. Alternatively, in a fourth modification, these cutouts N21, N51 may be eliminated.

In the first embodiment, the cover member 93, the opposing member 94 and the body main portion 21 are made of the non-magnetic material. Alternatively, in a fifth modification, the cover member 93, the opposing member 94 and/or the opposing member 94 may be made of a magnetic material instead of the non-magnetic material.

However, it is desirable that one of the cover member 93 and the body main portion 21 is made of the non-magnetic material or the like that has the degree of magnetism, which is lower than the degree of magnetism of the movable core 41 and/or the second stationary core 51. For example, in the structure, in which the cover member 93 is made of the magnetic material while the body main portion 21 is made of the non-magnetic material, even when the magnetic flux passes through the cover member 93, this magnetic flux is less likely to flow through the body main portion 21.

Furthermore, in the structure, in which the body main portion 21 is made of the magnetic material while the cover member 93 is made of the non-magnetic material, the magnetic flux does not pass through the cover member 93, and thereby the flow of the magnetic flux through the body main portion 21 is limited. Therefore, in any one of these structures, it is possible to limit the flow of the magnetic flux from the body main portion 21 to the second stationary core 51 without passing through the movable outside upper surface 43*a* that is the attractive surface of the movable core 41.

In the first embodiment, the cover body 90 includes the two members, i.e., the cover member 93 and the opposing member 94. In a sixth modification, the cover body 90 may include only the cover member 93. Even in this case, when the shape and the size of the cover member 93 are set to enable the slide movement of the slide member 33 along the cover member 93, the guiding function for guiding the movement of the slide member 33 and the function of forming the slide flow passage F27*s* can be implemented at the cover member 93.

In each of the above embodiments, when the movable structure M is moved in the valve closing direction, the cover upper chamber S1 implements the damper function. Alternatively, in a seventh modification, the cover upper chamber S1 may not implement the damper function. For example, instead of sliding the entire circumferential extent of the slide surface 33*a* of the slide member 33 along the opposing member 94, only a portion(s) of the circumferential extent of the slide surface 33*a* of the slide member 33 may slide along the opposing member 94. In this structure, for instance, the opposing member 94 is provided as a plurality of opposing members 94 that are arranged one after another at predetermined intervals. Even in this structure, the opposing members 94 can guide the movement of the movable structure M by sliding the slide member 33 along the opposing members 94.

In each of the above embodiments, the entire stationary boundary Q is included in the welding portion 96. In an eighth modification, at least a radially outer end portion of the stationary boundary Q may be included in the welding portion 96. In this structure, the welding portion 96 includes the portion of the body main portion 21 and the portion of the second stationary core 51 but does not include the cover member 93. Specifically, the cover member 93 is not fixed to the body main portion 21 and the second stationary core 51 by the welding portion 96. In this case, it is desirable that a height of the cover outer surface 90*a*, which is an outer peripheral surface of the cover member 93, is substantially equal to a sum of a height of the main portion outside inner surface 21*c* and a height of the second outside inner surface 53*b*. This is due to the following reason. Specifically, with this setting, a deviation of the position of the cover member 93 toward the injection-hole side is limited by the cutout tilt surface N21*a* of the body main portion 21, and a deviation of the position of the cover member 93 toward the counter-injection-hole side is limited by the cutout tilt surface N51*a* of the second stationary core 51.

In the cover body 90 of the first embodiment, both of the cover member 93 and the opposing member 94 are made of the non-magnetic material. In a ninth modification, the opposing member 94 may be made of the magnetic material. In this case, at the designing stage of the fuel injection valve 1, in a case of selecting the material of the opposing member 94, a high priority can be given to the hardness and the strength over the magnetism. Thereby, it is possible to limit the wearing and the deformation of the opposing member 94 upon the slide movement of the slide member 33.

In each of the above embodiments, at the stationary boundary Q, the welding portion 96 is formed by the welding. In a tenth modification, the welding portion 96 may not be formed. Specifically, the second stationary core 51 and the body main portion 21 may not be welded together. Even in this case, the stationary boundary Q is covered by the cover member 93, so that the fuel is less likely to reach the stationary boundary Q. Even if the fuel reaches the stationary boundary Q, since the gap, which is defined between: the second stationary core 51 and the body main portion 21; and the cover member 93, is very small, the fuel pressure applied to the stationary boundary Q tends to be reduced. Therefore, even though the second stationary core 51 and the body main portion 21 are not welded together, the separation between the second stationary core 51 and the body main portion 21 in the axial direction and the leakage of the fuel at the stationary boundary Q can be limited.

In each of the above embodiments, the movement of the movable structure M relative to the nozzle body 20 is guided at the three locations, i.e., the guide portions 30*b*, 31*b* and the slide member 33. In an eleventh modification, the movement of the movable structure M relative to the nozzle body 20 may be guided only at two locations among the guide portions 30*b*, 31*b* and the slide member 33. For example, the movement of the movable structure M relative to the nozzle body 20 may be guided at two locations, i.e., the injection-hole-side guide portion 30*b* and the slide member 33. In this structure, the required accuracy of the coaxiality of the movable structure M relative to the nozzle body 20 can be easily ensured in comparison to the structure, in which the number of the guide locations is three. Therefore, it is possible to limit an increase in the friction of the movable structure M relative to the nozzle body 20 at the time of moving the movable structure M.

In each of the above embodiments, the movable structure M includes the movable member 35 and the urging resilient member SP2. In a twelfth modification, the movable structure M may not include the movable member 35 and the urging resilient member SP2. Even in this structure, the restricting flow passage F22 is formed by the orifice 32*a* at the movable flow passage F20, so that a pressure difference is generated between the upstream fuel pressure PH and the downstream fuel pressure PL. Therefore, at the time of moving the movable structure M in the valve closing direction, the cover upper chamber S1 implements the damper function and thereby exerts the brake force against the movable structure M.

Figure 11:
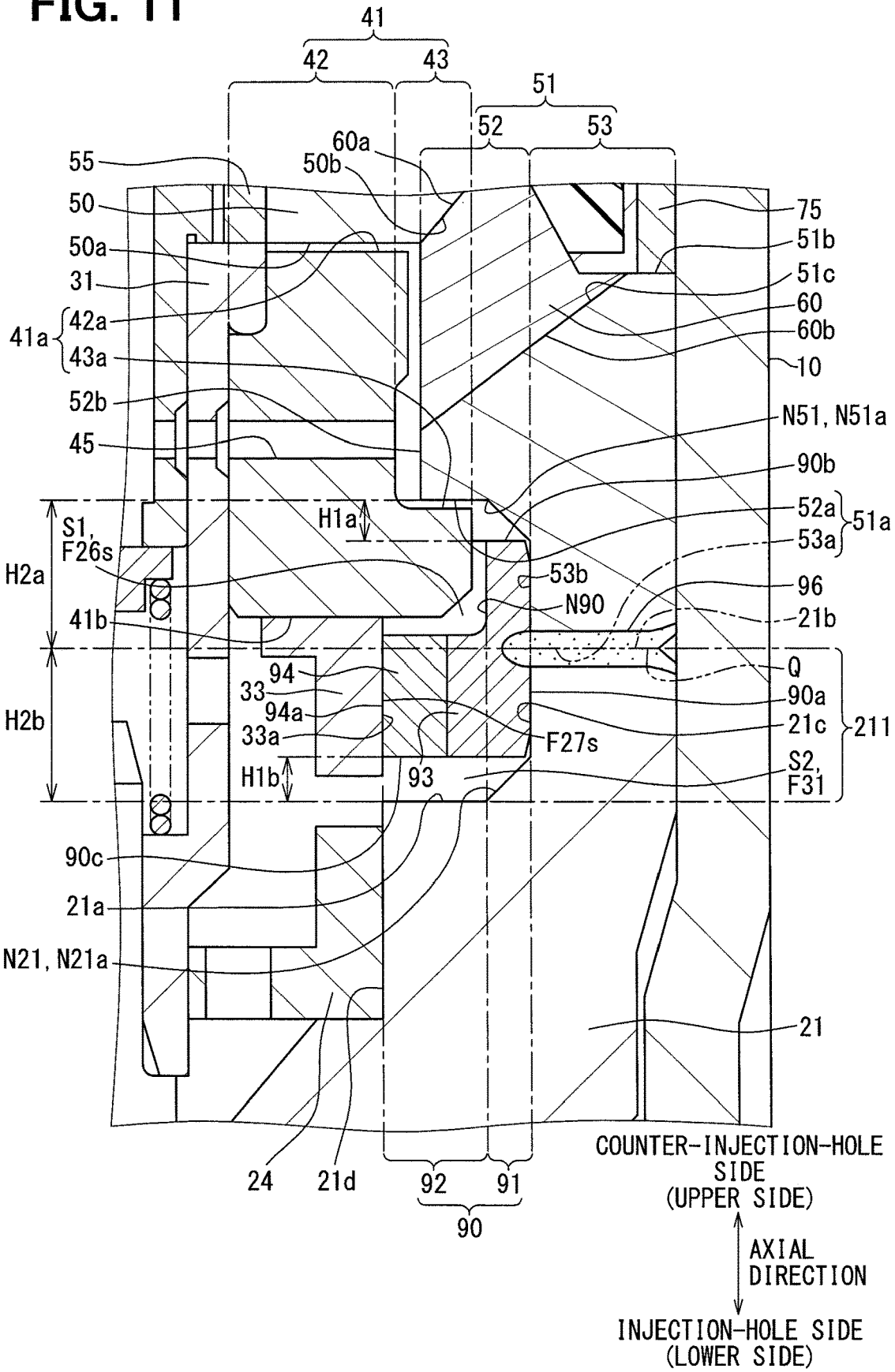
FIG. 11 is an enlarged view showing an area around a cover body in a thirteenth modification.

In each of the above embodiments, the portion of the stopper 55, which projects from the first stationary core 50 toward the injection-hole side, forms the projection that ensures the gap between the stationary core 50, 51 and the movable core 41. In a thirteenth modification, the projection may be formed at the movable structure M. For example, as shown in FIG. 11, at the movable structure M, a portion of the coupling member 31 projects from the movable core 41 toward the counter-injection-hole side, and this projecting portion of the coupling member 31 forms the projection. In this structure, the stopper 55 does not project from the first stationary core 50 toward the injection-hole side. Therefore, when the movement of the movable structure M is limited through the contact of the coupling member 31 against the stopper 55, the gap, which corresponds to the length of the projection of the coupling member 31 from the movable core 41, is ensured between the stationary core 50, 51 and the movable core 41.

In a fourteenth modification, a size of the gap between the first attractive surface and the stationary core may be set to be the same as or different from a size of the gap between the second attractive surface and the stationary core in each of the above embodiments. In the case where the sizes of these gaps are different from each other, it is desirable that one of the first attractive surface and the second attractive surface, which conducts the smaller amount of magnetic flux in comparison to the other one of the first attractive surface and the second attractive surface, has the larger size of the gap in comparison to the gap of the other one of the first attractive surface and the second attractive surface. This reason will be described below.

In a state where the fuel is filled in a form of thin film between the stationary core and the attractive surface, the attractive surface is not easily pulled off from the stationary core due to presence of linking. The strength of the linking is increased as the size of the gap between the stationary core and the attractive surface is reduced. Thereby, the responsiveness for starting of the valve closing movement relative to the turning off of the energization is deteriorated. However, when the size of the gap is increased to reduce the strength of the linking, the attractive force is reduced as a tradeoff. With respect to this point, even when the size of the gap is reduced at the attractive surface, which conducts the smaller amount of magnetic flux in comparison to the other attractive surface, the reduction in the size of the gap does not largely contribute to an increase in the attractive force. Therefore, it is more effective to reduce the strength of the linking by increasing the size of the gap.

Therefore, it is desirable to increase the size of the gap at one of the first attractive surface and the second attractive surface, which conducts the smaller amount of magnetic flux in comparison to the other one of the first attractive surface and the second attractive surface. In each of the above embodiments, the amount of magnetic flux, which passes through the attractive surface (the second attractive surface) located on the radially outer side is smaller than the amount of magnetic flux, which passes through the attractive surface (the first attractive surface) located on the radially inner side. Therefore, the size of the gap at the second attractive surface is set to be larger than the size of the gap at the first attractive surface.

Although the present disclosure has been described in view of the above embodiments, it should be understood that the present disclosure is not limited to the above embodiments and structures. The present disclosure also includes various modifications and variations within the equivalent range. In addition, various combinations and forms, and also other combinations and forms, each of which includes only one element or more or less, are within the scope of the present disclosure.

What is claimed is:

1. A fuel injection valve configured to inject fuel from an injection hole, comprising:

a coil that is configured to generate a magnetic flux when the coil is energized;

a stationary core that forms a portion of a flow passage, which is configured to conduct the fuel to the injection hole, wherein the stationary core is configured to become a passage of the magnetic flux;

a movable core that is configured to be attracted toward the stationary core when the movable core becomes a passage of the magnetic flux;

a passage forming portion that is placed on a downstream side of the stationary core in an axial direction of the coil and forms another portion of the flow passage; and a cover that has a wall covering a stationary boundary, which is a boundary between the passage forming portion and the stationary core, from a radially inner side of the stationary boundary where the flow passage is located, wherein:

at least one of a degree of magnetism of the passage forming portion and a degree of magnetism of the cover is lower than a degree of magnetism of the stationary core; and the stationary boundary includes a weld, by which the passage forming portion and the stationary core are welded together, and the weld contacts both of the passage forming portion and the stationary core and inwardly extends in a radial direction along the stationary boundary from a radially outer end of the stationary boundary.

2. The fuel injection valve according to claim 1, wherein the cover is a member that is formed separately from the passage forming portion and the stationary core.

3. The fuel injection valve according to claim 1, wherein the cover projects from both of the passage forming portion and the stationary core on the flow passage side of the passage forming portion and the stationary core where the flow passage is located; and each of a lower surface of the cover, which faces an injection hole side where the injection hole is located, and an upper surface of the cover, which faces an opposite side that is opposite to the injection hole, forms a corresponding portion of the flow passage.

4. The fuel injection valve according to claim 1, wherein:

the stationary core is defined as a second stationary core;

the fuel injection valve further comprises a first stationary core that is located on an upstream side of the second stationary core and forms a portion of the flow passage, wherein the first stationary core is configured to become a passage of the magnetic flux;

the movable core includes:

a first attractive surface that is configured to be attracted to the first stationary core when the magnetic flux passes through the first attractive surface; and a second attractive surface that is configured to be attracted to the second stationary core when the magnetic flux passes through the second attractive surface in a direction opposite to a direction of the magnetic flux when the magnetic flux passes through the first attractive surface;

a non-magnetic member made of a non-magnetic material is placed between the first stationary core and the second stationary core and is configured to limit occurrence of short circuiting of the magnetic flux between the first stationary core and the second stationary core without passing through the movable core; and the stationary boundary is a boundary between the second stationary core and the passage forming portion.

5. The fuel injection valve according to claim 1, wherein the weld joins the cover to the stationary boundary.

6. The fuel injection valve according to claim 1, comprising:

a movable structure that includes the movable core, wherein the movable structure is configured to be displaced in an axial direction of the coil when the movable core becomes the passage of the magnetic flux and is attracted toward the stationary core; and a guide that is located on a side of the cover, which is opposite to the stationary boundary, wherein the guide has a guide surface which is configured to guide movement of the movable structure when the movable structure is moved in response to attraction of the movable core toward the stationary core, wherein:

the guide is supported by the cover.

7. The fuel injection valve according to claim 6, comprising a body that includes the passage forming portion and receives the movable structure in an inside of the body while the body enables movement of the movable structure in the inside of the body, wherein:

the flow passage includes:

a main passage that is formed at an inside of the movable structure; and a sub-passage that is formed between the movable structure and the body;

the main passage includes a restricting flow passage, which is formed at a flow restricting portion of the movable structure by partially reducing a passage-cross sectional area of the main passage to restrict a flow rate at the restricting flow passage; and the sub-passage includes:

a separate flow passage, which is formed by a gap between the movable structure and the guide; and a cover upper chamber, which is formed by a gap between the movable structure and the cover at a location that is on an upstream side of the separate flow passage, wherein a passage cross-sectional area of the cover upper chamber is larger than a passage cross-sectional area of the separate flow passage.

8. The fuel injection valve according to claim 6, wherein:

the cover and the guide are made of separate members, respectively, which are formed separately from each other; and the degree of magnetism of the passage forming portion and the degree of magnetism of the cover are both lower than the degree of magnetism of the stationary core.

* * * * *